US010408477B2

(12) United States Patent
Shimamoto et al.

(10) Patent No.: US 10,408,477 B2
(45) Date of Patent: Sep. 10, 2019

(54) AIR-CONDITIONING APPARATUS

(71) Applicants: Daisuke Shimamoto, Tokyo (JP); Yuji Motomura, Tokyo (JP); Osamu Morimoto, Tokyo (JP); Takayoshi Honda, Tokyo (JP); Koji Nishioka, Tokyo (JP); Tatsuo Ono, Tokyo (JP)

(72) Inventors: Daisuke Shimamoto, Tokyo (JP); Yuji Motomura, Tokyo (JP); Osamu Morimoto, Tokyo (JP); Takayoshi Honda, Tokyo (JP); Koji Nishioka, Tokyo (JP); Tatsuo Ono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 220 days.

(21) Appl. No.: 14/441,007

(22) PCT Filed: Nov. 30, 2012

(86) PCT No.: PCT/JP2012/081073

§ 371 (c)(1),
(2) Date: May 6, 2015

(87) PCT Pub. No.: WO2014/083682

PCT Pub. Date: Jun. 5, 2014

(65) Prior Publication Data

US 2015/0285518 A1 Oct. 8, 2015

(51) Int. Cl.
*F24F 5/00* (2006.01)
*F25B 13/00* (2006.01)
(Continued)

(52) U.S. Cl.
CPC ..... *F24F 5/001* (2013.01); *F24F 5/0003* (2013.01); *F24F 11/83* (2018.01); *F25B 13/00* (2013.01);
(Continued)

(58) Field of Classification Search
CPC .. F25B 13/00; F25B 2313/006; F25B 43/003; F25B 2700/00; F24F 11/008
(Continued)

(56) References Cited

U.S. PATENT DOCUMENTS 5,285,647 A * 2/1994 Manz ..... F25B 45/00 62/127
5,309,729 A * 5/1994 Sagar ..... F25B 43/043 62/195
(Continued)

FOREIGN PATENT DOCUMENTS

CN 2289986 Y 9/1998
CN 2530197 Y 1/2003
(Continued)

OTHER PUBLICATIONS

Office Action dated Oct. 6, 2015 in the corresponding JP application No. 2014-549729 (with English translation).
(Continued)

*Primary Examiner* — Frantz F Jules
*Assistant Examiner* — Lionel Nouketcha
(74) *Attorney, Agent, or Firm* — Posz Law Group, PLC

(57) ABSTRACT

An air conditioning apparatus includes a refrigerant circuit in which a compressor for compressing heat source-side refrigerant, a first refrigerant channel switching device, a heat source side heat exchanger, an expansion device, and intermediate heat exchangers for performing heat exchange between the heat source-side refrigerant and a heat medium different from the heat source-side refrigerant are connected by pipes. Also, the air conditioning apparatus includes a heat medium circuit in which pumps for circulating the heat medium to be used for the heat exchange performed by the intermediate heat exchangers, a use-side heat exchanger, and channel switching devices for switching passages of the heat
(Continued)

medium heated or cooled to the use-side heat exchanger are connected by pipes. The heat medium circuit includes a strainer configured to capture foreign matter contained in the heat medium; and a heat medium relay unit control device configured to perform an operation that causes the strainer to capture foreign matter contained in the heat medium circuit during construction of the heat medium circuit.

7 Claims, 11 Drawing Sheets

(51) Int. Cl.
*F25B 43/00* (2006.01)
*F24F 11/83* (2018.01)
*F24F 140/12* (2018.01)
*F24F 140/20* (2018.01)

(52) U.S. Cl.
CPC ..... *F25B 43/003* (2013.01); *F24F 2140/12* (2018.01); *F24F 2140/20* (2018.01); *F25B 2313/006* (2013.01); *F25B 2313/0231* (2013.01); *F25B 2313/0272* (2013.01); *F25B 2313/02743* (2013.01); *F25B 2700/1931* (2013.01); *F25B 2700/1933* (2013.01)

(58) Field of Classification Search
USPC ..... 62/85, 175
See application file for complete search history.

(56) References Cited

U.S. PATENT DOCUMENTS 5,465,590 A * 11/1995 Van Steenburgh, Jr. ..... F25B 45/00 62/195
5,515,690 A * 5/1996 Blackmon ..... F25B 43/043 62/158
6,134,899 A * 10/2000 Brown ..... B60H 1/00585 62/126
6,539,970 B1 * 4/2003 Knowles ..... B08B 9/0321 137/15.04
2011/0192184 A1 * 8/2011 Yamashita ..... F24F 1/02 62/196.1
2011/0220586 A1 * 9/2011 Levitt ..... B01D 29/117 210/741
2012/0180515 A1 * 7/2012 Morimoto ..... F24F 3/06 62/324.6

FOREIGN PATENT DOCUMENTS

| | | | |
|---|---|---|---|
| EP | 2 314 939 | A1 | 4/2011 |
| JP | 2002-195583 | A | 7/2002 |
| JP | 2004-211927 | A | 7/2004 |
| JP | 2006-226236 | A | 8/2006 |
| JP | 2010-144977 | A | 7/2010 |
| KR | 20090055407 | A * | 6/2009 |
| WO | 2010/049998 | A1 | 5/2010 |
| WO | 2011/048646 | A1 | 4/2011 |
| WO | 2011/052033 | A1 | 5/2011 |
| WO | 2012/073293 | A1 | 6/2012 |

OTHER PUBLICATIONS

Extended European Search Report dated Jul. 11, 2016 issued in corresponding EP patent application No. 12889169.4.
Office Action dated Oct. 17, 2016 issued in the corresponding CN Patent application No. 201280077392.0 (and English translation).
International Search Report of the International Searching Authority dated Feb. 26, 2013 for the corresponding international application No. PCT/JP2012/081073 (and English translation).
Office Action dated Mar. 15, 2016 in the corresponding CN application No. 2012800773920.0 (with English translation).

* cited by examiner

AIR-CONDITIONING APPARATUS

CROSS REFERENCE TO RELATED APPLICATION

This application is a U.S. national stage application of International Application No. PCT/JP2012/081073 filed on Nov. 30, 2012, the disclosure of which is incorporated by reference.

TECHNICAL FIELD

The present invention relates to an air-conditioning apparatus to be applied to, for example, a multi-air-conditioning apparatus for buildings.

BACKGROUND ART

In some air-conditioning apparatuses such as a multi-air-conditioning apparatus for buildings, a heat source unit (an outdoor unit) is disposed outside a structure, and an indoor unit is disposed in a room of the structure. Refrigerant circulating in a refrigerant circuit of such an air-conditioning apparatus dissipates (or absorbs) heat to/from air supplied to a heat exchanger of the indoor unit, and heats or cools the air. The indoor unit sends the heated or cooled air to an air-conditioned space, thereby heating or cooling an interior space (the air-conditioned space).

Since a building generally includes a plurality of interior spaces separated from one another by, for example, walls, the air-conditioning apparatus also includes a plurality of indoor units. For a large building, refrigerant pipes connecting the outdoor unit and the indoor units are 100 m in length in some cases. Such a large length of the pipes connecting the outdoor unit and the indoor units increases the amount of refrigerant with which a refrigerant circuit is charged accordingly.

An indoor unit of such a multi-air-conditioning apparatus for buildings is generally used while being disposed in an interior space (e.g., an office, a living room, or a store) where a person is present. When refrigerant leaks from an indoor unit disposed in the interior space for some reasons, this leakage might cause problems with respect to its influence on the human body and safety because some types of refrigerants are flammable and/or toxic. Even a leakage of refrigerant that is not harmful to the human body might cause a decrease in oxygen concentration in the interior space and affect the human body.

To solve such problems as described above, an air-conditioning apparatus of a proposed technique employs a secondary loop system. Specifically, the secondary loop system is used for air-conditioning an interior space where a human is present by including a primary loop serving as a refrigerant circuit in which refrigerant circulates and a secondary loop serving as a heat medium circuit in which an unharmful heat medium such as water or brine circulates (see, for example, Patent Literature 1).

CITATION LIST

Patent Literature

Patent Literature 1: WO2010/049998 (page 3 and FIG. 1, for example)

SUMMARY OF INVENTION

Technical Problem

For example, in a technique as proposed in Patent Literature 1, water or a solution in which brine is mixed in water is used as a heat medium circulating in a secondary loop. In particular, in a process of constructing the secondary loop, foreign matter and air are easily trapped in the circuit. If an air-conditioning operation is performed with the secondary loop contaminated by foreign matter and air, failures or other problems might occur. Thus, measures such as removal of the contaminants are required.

It is therefore an object of the present invention to provide an air-conditioning apparatus that can perform a control operation for removing foreign matter and air before the air-conditioning apparatus operates.

Solution to Problem

An air-conditioning apparatus according to the present invention includes: a refrigerant circuit in which a compressor for compressing a heat source-side refrigerant, a refrigerant channel switching device for switching a circulation path of the heat source-side refrigerant, a heat source side heat exchanger for performing heat exchange of the heat source-side refrigerant, an expansion device for adjusting a pressure of the heat source-side refrigerant, and one or more intermediate heat exchangers for performing heat exchange between the heat source-side refrigerant and a heat medium different from the heat source-side refrigerant are connected by pipes; a heat medium circuit in which one or more pumps for circulating the heat medium to be used for the heat exchange performed by the one or more intermediate heat exchangers, a use-side heat exchanger for performing heat exchange between the heat medium and air in an air-conditioned space, and a channel switching device for switching passages of the heat medium heated or cooled to the use-side heat exchanger are connected by pipes, the heat medium circuit including a strainer disposed at a suction side of the one or more pumps and configured to capture foreign matter contained in the heat medium; and a controller configured to perform a foreign matter removal operation of causing the strainer to capture foreign matter contained in the heat medium circuit during construction of the heat medium circuit.

Advantageous Effects of Invention

According to the present invention, the controller performs the foreign matter removal operation in constructing the heat medium circuit. Thus, foreign matter can be efficiently removed.

DESCRIPTION OF EMBODIMENTS

Embodiment 1

Figure 1:
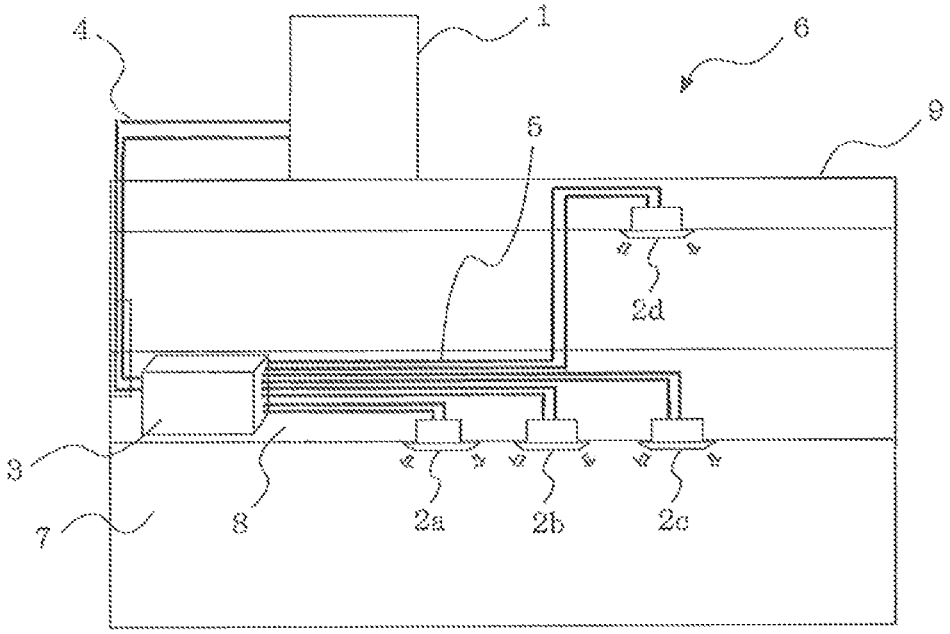
FIG. 1 schematically illustrates an example of an installation of an air-conditioning apparatus according to Embodiment 1 of the present invention.

FIG. 1 schematically illustrates an example of an installation of an air-conditioning apparatus 100 according to Embodiment 1 of the present invention. Referring to FIG. 1, the example installation of the air-conditioning apparatus 100 will be described. Similar devices designated by suffixes, for example, may be collectively referred to without the suffixes when these devices do not need to be individually distinguished or specified. The levels of, for example, temperature and pressure are not determined based on specific absolute values, and are determined relative to the states, operation, and other factors in, for example, a system or a device.

The air-conditioning apparatus 100 causes refrigerant to circulate and cools or heats an interior space by using a refrigeration cycle. Indoor units 2*a* to 2*d* can freely select a cooling mode or a heating mode as an operation mode. The air-conditioning apparatus 100 of this embodiment includes a refrigerant circuit A using, as refrigerant, a single refrigerant such as R-22, R-32, or R-134a, a near-azeotropic refrigerant mixture such as R-410A or R-404A, a zeotropic refrigerant mixture such as R-407C, refrigerant that includes a double bond in its chemical formula, such as $CF_3CF{=}CH_2$, and is regarded as refrigerant having a relatively low global warming potential, and a mixture thereof, or a natural refrigerant such as $CO_2$ or propane, and a heat medium circuit B using water, for example, as a heat medium.

The air-conditioning apparatus 100 of this embodiment employs a technique (indirect technique) that indirectly uses refrigerant (a heat source-side refrigerant). Specifically, cooling energy or heating energy stored in a heat source-side refrigerant is transferred to refrigerant (hereinafter referred to as a heat medium) such as water or brine different from the heat source-side refrigerant so that an air-conditioned space is cooled or heated with cooling energy or heating energy stored in the heat medium.

As illustrated in FIG. 1, the air-conditioning apparatus 100 of this embodiment includes one outdoor unit 1 as a heat source unit, a plurality of indoor units 2, and a heat medium relay unit 3 interposed between the outdoor unit 1 and the indoor units 2. The heat medium relay unit 3 performs heat exchange between the heat source-side refrigerant and the heat medium. The outdoor unit 1 is connected to the heat medium relay unit 3 by refrigerant pipes 4 to allow the heat source-side refrigerant to circulate. The heat medium relay unit 3 is connected to the indoor units 2 by pipes (heat medium pipes) 5 to allow the heat medium to circulate. Cooling energy or heating energy generated by the outdoor unit 1 is sent to the indoor units 2 through the heat medium relay unit 3.

The outdoor unit 1 is generally disposed in an outdoor space 6 that is a space (e.g., a rooftop) outside a structure 9 such as a building, and supplies cooling energy or heating energy to the indoor units 2 through the heat medium relay unit 3.

The indoor units 2 are disposed at a location so that indoor units 2 can supply cooling air or heating air to an interior space 7 that is a space (e.g., a room) inside the structure 9, and supply cooling air or heating air to the interior space 7 serving as an air-conditioned space.

The heat medium relay unit 3 is placed in a housing different from the outdoor unit 1 and the indoor units 2, and is disposed at a location different from the outdoor space 6 and the interior space 7. The heat medium relay unit 3 is connected to the outdoor unit 1 through the refrigerant pipes 4 and to the indoor units 2 through the pipes 5 so as to transmit cooling energy or heating energy from the outdoor unit 1 to the indoor units 2.

As illustrated in FIG. 1, in the air-conditioning apparatus 100 of this embodiment, the outdoor unit 1 and the heat medium relay unit 3 are connected to each other through two refrigerant pipes 4, and the heat medium relay unit 3 is connected to the indoor units 2*a* to 2*d* through two pipes 5. In this manner, in the air-conditioning apparatus 100 of Embodiment 1, units (i.e., the outdoor unit 1, the indoor units 2, and the heat medium relay unit 3) are connected to each other through the refrigerant pipes 4 and the pipes 5, thereby simplifying the construction process.

In the example illustrated in FIG. 1, the heat medium relay unit 3 is installed in a space (e.g., a space such as a space above a ceiling in the structure 9, which hereinafter is simply referred to as a space 8) that is inside the structure 9 but is different from the interior space 7. The heat medium relay unit 3 may be installed in, for example, a common space including, for example, an elevator. In the example illustrated in FIG. 1, the indoor units 2 are of a ceiling cassette type, but the present invention is not limited to this type. Specifically, the air-conditioning apparatus 100 may be of a ceiling concealed type, a ceiling suspension type, or other types, as long as the air-conditioning apparatus 100 can blow heating air or cooling air to the interior space 7 directly or through a duct, for example.

The heat medium relay unit 3 may be disposed near the outdoor unit 1. However, it should be noted that if the distance from the heat medium relay unit 3 to the indoor units 2 is excessively long, conveyance power of the heat medium significantly increases, and thus, the energy saving effect decreases.

Figure 2:
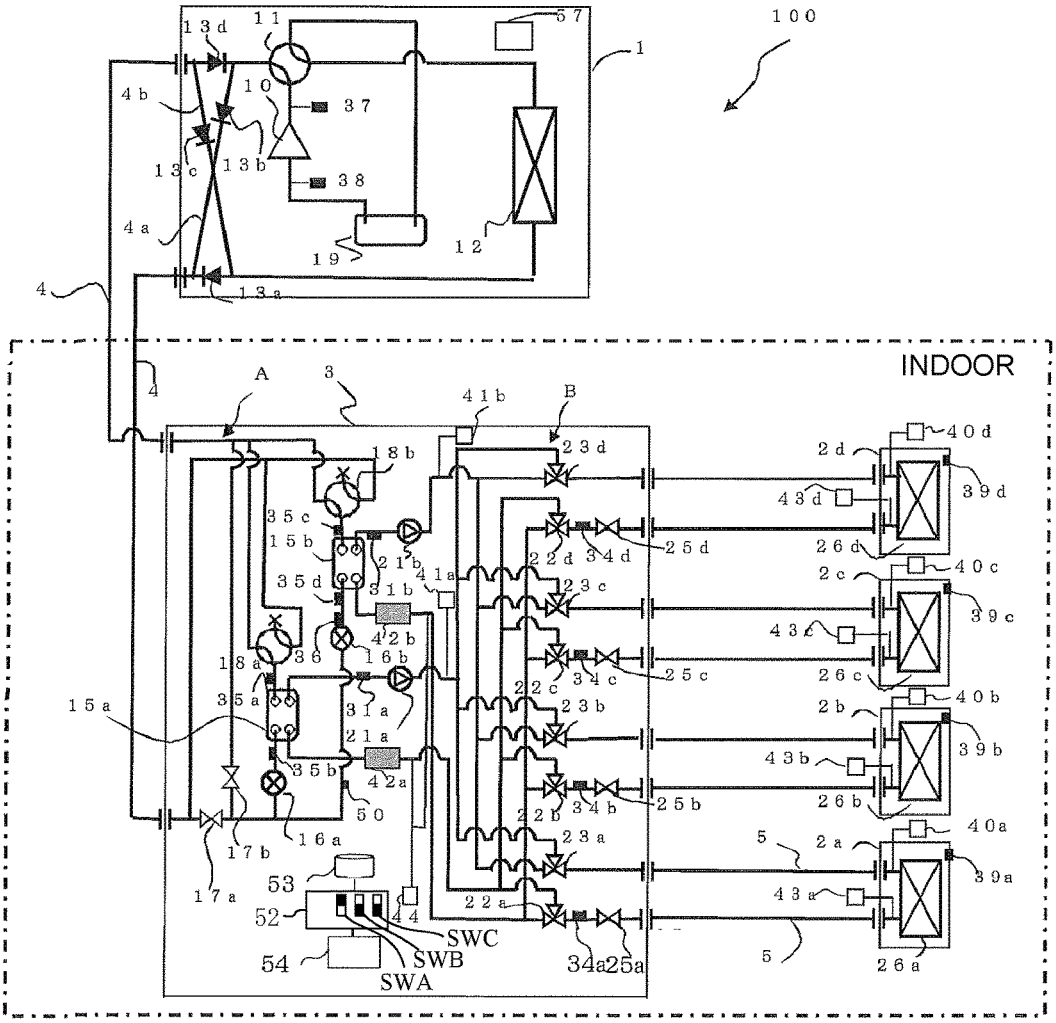
FIG. 2 illustrates an example refrigerant circuit configuration of the air-conditioning apparatus of Embodiment 1.

FIG. 2 illustrates an example refrigerant circuit configuration of the air-conditioning apparatus 100 of Embodiment 1.

As illustrated in FIG. 2, the outdoor unit 1 and the heat medium relay unit 3 are connected to each other by the refrigerant pipes 4 through an intermediate heat exchanger 15*a* and an intermediate heat exchanger 15*b* included in the heat medium relay unit 3. The heat medium relay unit 3 is connected to the indoor units 2 by the pipes 5.

[Outdoor Unit 1]

The outdoor unit 1 includes a compressor 10 that compresses refrigerant, a first refrigerant channel switching device 11 of, for example, a four-way valve, a heat source side heat exchanger 12 operating as an evaporator or a condenser, and an accumulator 19 that stores surplus refrigerant. These components are connected to the refrigerant pipes 4.

The outdoor unit 1 includes a first connection pipe 4*a*, a second connection pipe 4*b*, a check valve 13*a*, a check valve 13*b*, a check valve 13*c*, and a check valve 13*d*. The first connection pipe 4*a*, the second connection pipe 4*b*, the check valve 13*a*, the check valve 13*b*, the check valve 13*c*, and the check valve 13*d* enable flow of a heat source-side refrigerant into the heat medium relay unit 3 in one direction, irrespective of an operation required by the indoor units 2.

The compressor 10 sucks a heat source-side refrigerant, compresses the heat source-side refrigerant into a high-temperature, high-pressure state, and may be, for example, an inverter compressor whose capacity can be controlled.

The first refrigerant channel switching device 11 switches the heat source-side refrigerant between a flow in a heating operation mode (a heating-only operation mode and a heating main operation mode) and a flow in a cooling operation mode (a cooling-only operation mode and a cooling main operation mode).

The heat source side heat exchanger 12 operates as an evaporator in the heating operation, operates as a condenser in the cooling operation, and performs heat exchange between air supplied from an air-sending device such as a fan (not shown) and the heat source-side refrigerant.

The accumulator 19 is disposed at a suction side of the compressor 10.

A second pressure sensor 37 and a third pressure sensor 38 that are pressure detectors are provided at the upstream and downstream sides of the compressor 10 so as to calculate the flow rate of refrigerant from the compressor 10 based on the rotation speed of the compressor 10 and values detected by the second pressure sensor 37 and the third pressure sensor 38.

[Indoor Units 2]

Each of the indoor units 2 includes a use-side heat exchanger 26. The use-side heat exchanger 26 is connected to a heat medium flow rate control device 25 and a second heat medium channel switching device 23 of the heat medium relay unit 3 through the pipes 5. The use-side heat exchanger 26 performs heat exchange between air from an air-sending device such as a fan (not shown), and a heat medium, and generates heating air or cooling air to be supplied to the interior space 7. Each of the indoor units 2 also includes an air purge valve 40 for purging air remaining in the heat medium circuit B in construction, for example. Each of the indoor units 2 also includes an indoor unit heat medium inlet 43 for introducing the heat medium in construction. Each of the indoor units 2 of this embodiment includes a sucked air temperature detecting device 39.

[Heat Medium Relay Unit 3]

The heat medium relay unit 3 includes intermediate heat exchangers 15*a* and 15*b* for exchanging heat between the refrigerant and the heat medium, two expansion devices 16*a* and 16*b* for reducing the pressure of the refrigerant, two opening/closing devices 17*a* and 17*b* for opening and closing channels in the refrigerant pipes 4, two second refrigerant channel switching devices 18 and 18*b* for switching refrigerant channels, two pumps 21 and 21*b* for circulating the heat medium, four first heat medium channel switching devices 22*a* to 22*d* connected to one side of the pipes 5, four second heat medium channel switching devices 23*a* to 23*d* connected to the other side of the pipes 5, and four heat medium flow rate control devices 25*a* to 25*d* connected to the pipes 5 to which the second heat medium channel switching devices 22 are connected.

The two intermediate heat exchangers 15*a* and 15*b* (also collectively referred to as the intermediate heat exchangers 15) serve as condensers (radiators) or evaporators, and perform heat exchange between the heat source-side refrigerant and the heat medium, transferring cooling energy or heating energy generated in the outdoor unit 1 and stored in the heat source-side refrigerant to the heat medium. The intermediate heat exchanger 15*a* is disposed between the expansion device 16*a* and the second refrigerant channel switching device 18*a* in the refrigerant circuit A, and is used for cooling the heat medium in a cooling and heating mixed operation mode. The intermediate heat exchanger 15*b* is disposed between the expansion device 16*b* and the second refrigerant channel switching device 18*b* in the refrigerant circuit A, and is used for heating the heat medium in a cooling and heating mixed operation mode.

The two expansion devices 16*a* and 16*b* (also collectively referred to as the expansion devices 16) function as pressure reducing valves or expansion valves, and reduce the pressure of the heat source-side refrigerant so as to expand the heat source-side refrigerant. The expansion device 16*a* is disposed upstream of the intermediate heat exchanger 15*a* with regard to the flow of the heat source-side refrigerant in the cooling-only operation mode. The expansion device 16*b* is disposed upstream of the intermediate heat exchanger 15*b* with regard to the flow of the heat source-side refrigerant in the cooling-only operation mode. The two expansion devices 16 are preferably components having variable opening degrees, such as electronic expansion valves.

The opening/closing devices 17*a* and 17*b* are two-way valves, for example, and open and close the refrigerant pipes 4.

The two second refrigerant channel switching devices 18*a* and 18*b* (also collectively referred to as the second refrigerant channel switching devices 18) are four-way valves, for example, and switch the flow of the heat source-side refrigerant in accordance with the operation mode. The second refrigerant channel switching device 18*a* is disposed downstream of the intermediate heat exchanger 15*a* with regard to the flow of the heat source-side refrigerant in the cooling-only operation mode. The second refrigerant channel switching device 18*b* is disposed downstream of the intermediate heat exchanger 15*b* with regard to the flow of the heat source-side refrigerant in the cooling-only operation mode.

The two pumps 21*a* and 21*b* (also collectively referred to as the pumps 21) cause a heat medium in the pipes 5 to circulate. The pump 21*a* is provided in the pipe 5 between the intermediate heat exchanger 15*a* and the second heat medium channel switching device 23. The pump 21*b* is provided in the pipe 5 between the intermediate heat exchanger 15*b* and the second heat medium channel switching device 23. The two pumps 21 can be pumps whose capacities can be controlled, for example. The pump 21*a* may be provided in the pipe 5 between the intermediate heat exchanger 15*a* and the first heat medium channel switching device 22.

The four first heat medium channel switching devices 22*a* to 22*d* (also collectively referred to as the first heat medium channel switching devices 22) are three-way valves, for example, and switch channels of the heat medium. The number (four in this example) of the first heat medium channel switching devices 22 is selected in accordance with the number of the indoor units 2*a* to 2*d*. One of the three ports of each of the first heat medium channel switching devices 22 is connected to the intermediate heat exchanger 15*a*, another port is connected to the intermediate heat exchanger 15*b*, and the other port is connected to the heat medium flow rate control device 25, and the first heat medium channel switching devices 22 are disposed at the outlet of the heat medium channel of the use-side heat exchanger 26*a*. The first heat medium channel switching devices are designated 22*a*, 22*b*, 22*c*, and 22*d* from the bottom of the drawing sheet in correspondence with the indoor units 2*a* to 2*d*. The first heat medium channel switching devices 22*a*, 22*b*, 22*c*, and 22*d* are provided in the heat medium relay unit 3, and a larger number of first heat medium channel switching devices may be provided.

The four second heat medium channel switching devices 23*a* to 23*d* (also collectively referred to as the second heat medium channel switching devices 23) are three-way valves, for example, and switch channels of the heat medium. The number (four in this example) of the second heat medium channel switching devices 23 is selected in accordance with the number of the indoor units 2. One of the three ports of each of the second heat medium channel switching devices 23 is connected to the intermediate heat exchanger 15*a*, another port is connected to the intermediate heat exchanger 15*b*, and the other port is connected to the use-side heat exchanger (or heat recovery heat exchanger) 26, and the second heat medium channel switching devices 23 are disposed at the inlet of the heat medium channel of the use-side heat exchanger (or the heat recovery heat exchanger) 26. The second heat medium channel switching devices are designated 23*a*, 23*b*, 23*c*, and 23*d* from the bottom of the drawing sheet in correspondence with the indoor units 2*a* to 2*d*. The second heat medium channel switching devices 23*a*, 23*b*, 23*c*, and 23*d* are provided in the heat medium relay unit 3, and a larger number of second heat medium channel switching devices may be provided.

The four heat medium flow rate control devices 25*a* to 25*d* (also collectively referred to as the heat medium flow rate control devices 25) are two-way valves whose opening areas can be controlled, for example, to adjust the flow rate of the heat medium flowing in the pipes 5. The number (four in this example) of the heat medium flow rate control devices 25 is selected in accordance with the number of the indoor units 2. One of the heat medium flow rate control devices 25 is connected to the use-side heat exchanger (or the heat recovery heat exchanger) 26, the other heat medium flow rate control device 25 is connected to the first heat medium channel switching device 22, and the heat medium flow rate control devices 25 are disposed at the outlet of the heat medium channel of the use-side heat exchanger 26. The heat medium flow rate control devices are designated 25*a*, 25*b*, 25*c*, and 25*d* from the bottom of the drawing sheet in correspondence with the indoor units 2*a* to 2*d*. The heat medium flow rate control devices 25*a*, 25*b*, 25*c*, and 25*d* are provided in the heat medium relay unit 3, and a larger number of heat medium flow rate control devices may be provided.

The heat medium flow rate control devices 25 may be disposed at the inlet of the heat medium channel of the use-side heat exchanger 26.

In a manner similar to the air purge valve 40, the heat medium relay unit 3 includes a heat medium relay unit air purge valve 41 for purging air remaining in the heat medium circuit B in construction. The heat medium circuit B includes strainers 42 for capturing foreign matter flowing with the heat medium in order to prevent the foreign matter from circulating. To prevent the pumps 21 from sucking foreign matter, the pipes at the refrigerant inlets of the intermediate heat exchangers 15 disposed at the suction side of the pumps 21 are provided with the strainers 42 of this embodiment. The strainers 42 are configured such that mesh parts for capturing foreign matter can be detached from the bodies thereof. Thus, foreign matter captured by the strainers 42 can be easily removed during, for example, maintenance. A heat medium relay unit heat medium inlet 44 for introducing the heat medium to the heat medium circuit B during, for example, construction is also provided.

In addition, the heat medium relay unit 3 includes various detection means (i.e., two first temperature sensors 31*a* and 31*b*, four second temperature sensors 34*a* to 34*d*, four third temperature sensors 35*a* to 35*d*, one fourth temperature sensor 50, and a first pressure sensor 36). Information (e.g., temperature information and pressure information) detected by these detection means is sent to a controller that integrally controls the air-conditioning apparatus 100, and is used for controlling the driving frequency of the compressor 10, the rotation speeds of air-sending devices (not shown) disposed near the heat source side heat exchangers 12 and the use-side heat exchangers 26, switching of the first refrigerant channel switching device 11, the driving frequencies of the pumps 21, switching of the second refrigerant channel switching device 18, and switching of the channel of the heat medium.

The heat medium relay unit control device 52 and the outdoor unit control device 57 serving as controllers are microcomputers, for example, and integrally control components and means constituting the air-conditioning apparatus 100 in order to execute operation modes, which will be described later. The heat medium relay unit control device 52 and the outdoor unit control device 57 are connected to each other such that the heat medium relay unit control device 52 and the outdoor unit control device 57 can communicate with each other and perform control cooperatively. In this embodiment, the heat medium relay unit control device 52 and the outdoor unit control device 57 are disposed separately and perform control cooperatively. Alternatively, the heat medium relay unit control device 52 and the outdoor unit control device 57 may be a single controller so as to control the air-conditioning apparatus 100, for example.

The heat medium relay unit control device 52 and the outdoor unit control device 57 calculate the evaporation temperature, the condensation temperature, the saturation temperature, the degree of superheating, and the degree of subcooling, for example. Based on the calculation results, the opening degree of the expansion device 16, the driving frequency of the compressor 10, and the speed (including on/off) of a fan (not shown) that sends air to the heat source side heat exchanger 12 and the use-side heat exchangers 26, for example, are controlled. On the basis of physical values obtained by detection of the sensors and instruction received from a remote controller, for example, the controller controls switching of the first refrigerant channel switching device 11, driving of the pumps 21, the opening degrees of the expansion devices 16, on/off of the opening/closing devices 17, switching of the second refrigerant channel switching device 18, switching of the first heat medium channel switching device 22, switching of the second heat medium channel switching device 23, and the opening degrees of the heat medium flow rate control devices 25, for example.

In particular, the heat medium relay unit control device 52 records data concerning removal of foreign matter and history of an air purge operation. Data concerning history refers to, for example, removal of foreign matter and the date and time, and termination time of the air purge operation. Thus, the heat medium relay unit control device 52 includes a timer (not shown) so as to determine the time. The heat medium relay unit 3 includes a recording device 53 for recording data concerning history. The heat medium relay unit 3 also includes a display device 54 for displaying the history recorded in the recording device 53 so as to display the history. Although the display device 54 displays the history in this example, the data concerning history may be transmitted by a communication device, for example. The recording device 53 and the display device 54, for example, may be disposed near the outdoor unit 1 such that the outdoor unit control device 57 performs processing.

The heat medium relay unit control device 52 of this embodiment additionally includes control changing switches. In this embodiment, the heat medium relay unit control device 52 includes at least three types of switches: switches SWA, SWB, and SWC. When the switch SWA is turned on, an operation in a foreign matter removal operation mode, which will be described later, is performed. When the switch SWB is turned on, an operation in an air purge operation mode, which will be described later, is performed. The switch SWC is a switch that is turned on or off when the operation in the foreign matter removal operation mode or the air purge operation mode is aborted because of an occurrence of an abnormal event, for example. In this embodiment, since operations in the foreign matter removal operation mode and the air purge operation mode in the heat medium circuit B are performed, the control changing switches are provided in the heat medium relay unit control device 52. Alternatively, the switches may be provided in the outdoor unit control device 57 if a switching operation is more easily performed when the switches are included in the outdoor unit 1 depending on the positional relationship.

The two first temperature sensors 31*a* and 31*b* (also collectively referred to as the first temperature sensors 31) detect the temperature of the heat medium that has flowed from the intermediate heat exchangers 15, that is, the heat medium at the outlet of the intermediate heat exchangers 15, and are preferably thermistors, for example. The first temperature sensor 31*a* is provided in the pipe 5 at the inlet of the pump 21*a*. The first temperature sensor 31*b* is provided in the pipe 5 at the inlet of the pump 21*b*.

The four second temperature sensors 34*a* to 34*d* (also collectively referred to as the second temperature sensors 34) are provided between the first heat medium channel switching device 22 and the heat medium flow rate control device 25, detect the temperature of the heat medium that has flowed from the use-side heat exchangers (or the heat recovery heat exchangers) 26, and are preferably thermistors, for example. The number (four in this example) of the second temperature sensors 34 is selected in accordance with the number of the indoor units 2. The second temperature sensors are designated 34*a*, 34*b*, 34*c*, and 34*d* from the bottom of the drawing sheet in correspondence with the indoor units 2.

The four third temperature sensors 35*a* to 35*d* (also collectively referred to as the third temperature sensors 35) are disposed at the inlet or outlet of the heat source-side refrigerant of the intermediate heat exchangers 15, detect the temperature of the heat source-side refrigerant flowing in the intermediate heat exchangers 15 or heat source-side refrigerant that has flowed from the intermediate heat exchangers 15, and are preferably thermistors, for example. The third temperature sensor 35*a* is disposed between the intermediate heat exchanger 15*a* and the second refrigerant channel switching device 18*a*. The third temperature sensor 35*b* is disposed between the intermediate heat exchanger 15*a* and the expansion device 16*a*. The third temperature sensor 35*c* is disposed between the intermediate heat exchanger 15*b* and the second refrigerant channel switching device 18*b*. The third temperature sensor 35*d* is disposed between the intermediate heat exchanger 15*b* and the expansion device 16*b*.

The fourth temperature sensor 50 is configured to obtain temperature information for use in calculating an evaporation temperature and a dewpoint temperature, for example, and is disposed between the expansion device 16*a* and the expansion device 16*b*.

The pipes 5 that allow the heat medium to circulate are composed of pipes connected to the intermediate heat exchanger 15*a* and pipes connected to the intermediate heat exchanger 15*b*. The pipes 5 are branched (into four parts in this example) depending on the number of the indoor units 2 connected to the heat medium relay unit 3. The pipes 5 are connected to the first heat medium channel switching device 22 and the second heat medium channel switching device 23. It is determined whether the heat medium from the intermediate heat exchanger 15*a* has been caused to flow into the use-side heat exchanger 26 or the heat medium from the intermediate heat exchanger 15*b* has been caused to flow into the use-side heat exchanger 26, by controlling the first heat medium channel switching device 22 and the second heat medium channel switching device 23.

[Operation Mode]

In the air-conditioning apparatus 100, the refrigerant circuit A is constituted by connecting, through the refrigerant pipes 4, the compressor 10, the first refrigerant channel switching device 11, the heat source side heat exchanger 12, the opening/closing devices 17, the second refrigerant channel switching devices 18, the refrigerant channel of the intermediate heat exchanger 15*a*, the expansion devices 16, and the accumulator 19. In addition, the heat medium circuit B is constituted by connecting, through the pipes 5, the heat medium channel of the intermediate heat exchanger 15*a*, the pumps 21, the first heat medium channel switching devices 22, the heat medium flow rate control devices 25, the use-side heat exchangers (or heat recovery heat exchangers) 26, and the second heat medium channel switching devices 23. That is, the intermediate heat exchangers 15 are individually connected to the use-side heat exchangers 26 in parallel, and thereby, the heat medium circuit B has a plurality of systems.

Thus, in the air-conditioning apparatus 100, the outdoor unit 1 and the heat medium relay unit 3 are connected to each other through the intermediate heat exchanger 15*a* and the intermediate heat exchanger 15*b* provided in the heat medium relay unit 3, and the heat medium relay unit 3 and the indoor units 2 are connected to each other through the intermediate heat exchanger 15*a* and the intermediate heat exchanger 15*b*. That is, in the air-conditioning apparatus 100, the intermediate heat exchanger 15*a* and the intermediate heat exchanger 15*b* exchange heat between the heat source-side refrigerant circulating in the refrigerant circuit A and the heat medium circulating in the heat medium circuit B.

Operation modes of the air-conditioning apparatus 100 will now be described. The air-conditioning apparatus 100 is configured such that the indoor units 2 can perform a cooling operation or a heating operation based on instructions received from the indoor units 2. That is, in the air-conditioning apparatus 100, all the indoor units 2 are allowed to perform the same operation and also to perform different operations.

Operation modes of the air-conditioning apparatus 100 include: a cooling-only operation mode in which all the driven indoor units 2 perform a cooling operation; a heating-only operation mode in which all the driven indoor units 2 perform a heating operation; a cooling main operation mode as a cooling and heating mixed operation mode in which a cooling load is larger than a heating load; and a heating main operation mode as a cooling and heating mixed operation mode in which a heating load is larger than a cooling mode. The operation modes also include special modes, which are an air purge operation mode for removing air from a water-side circuit during, for example, construction and a foreign matter removal operation mode for collecting foreign matter in the strainers 42. The flow in the circuits is basically the same in the foreign matter removal operation mode and the air purge operation mode. The operation modes will now be described in relation to the flow of the heat source-side refrigerant and the flow of the heat medium.

[Cooling-Only Operation Mode]

Figure 3:
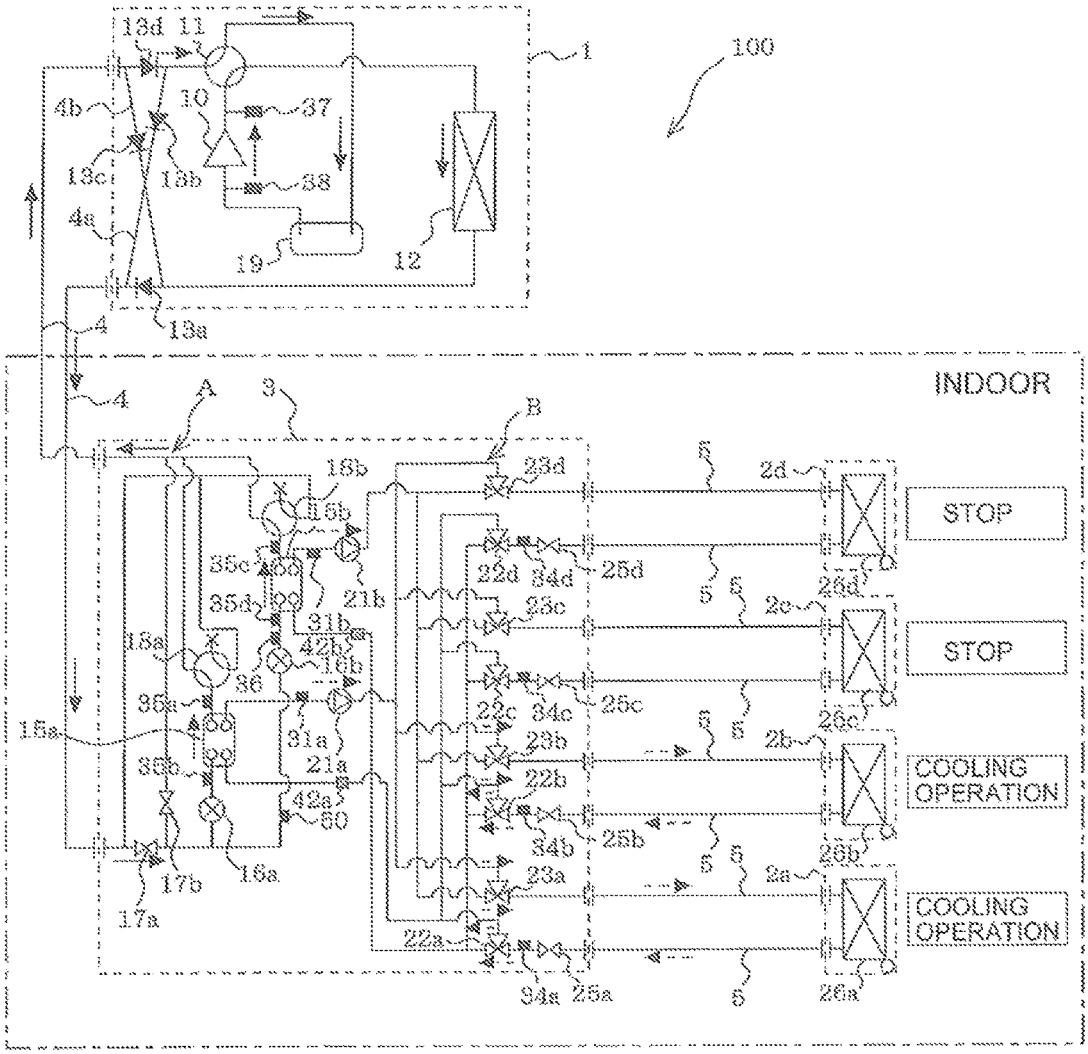
FIG. 3 is a refrigerant circuit diagram showing a flow of refrigerant in a cooling-only operation mode of the air-conditioning apparatus illustrated in FIG. 2.

FIG. 3 is a refrigerant circuit diagram showing a flow of the refrigerant in the cooling-only operation mode (pattern 1) of the air-conditioning apparatus 100 illustrated in FIG. 2. Referring to FIG. 3, the cooling-only operation mode in a case where the indoor units of the use-side heat exchangers 26*a* to 26*b* generate cooling loads will be described as an example. In FIG. 3, the direction of flow of the heat source-side refrigerant is indicated by solid arrows, and the direction of flow of the heat medium is indicated by dashed arrows. In FIGS. 3 to 7, equipment (e.g., the indoor unit air purge valve 40 and the heat medium relay unit air purge valve 41) not related to the flow of the refrigerant are not shown.

In the case of the cooling-only operation mode shown in FIG. 3, in the outdoor unit 1, the first refrigerant channel switching device 11 is switched such that the heat source-side refrigerant discharged from the compressor 10 flows into the heat source side heat exchanger 12. In the heat medium relay unit 3, the pump 21*a* and the pump 21*b* are driven, the heat medium flow rate control devices 25*a* and 25*b* are opened, and the heat medium flow rate control devices 25*c* and 25*d* are closed so that the heat medium circulates between each of the intermediate heat exchanger 15*a* and the intermediate heat exchanger 15*b* and the use-side heat exchangers 26*a* to 26*b*.

First, flow of the heat source-side refrigerant in the refrigerant circuit A will be described.

The low-temperature low-pressure refrigerant is compressed by the compressor 10, becomes a high-temperature high-pressure gas refrigerant, and is discharged. The other part of the high-temperature high-pressure gas refrigerant from the compressor 10 flows into the heat source side heat exchanger 12 through the first refrigerant channel switching device 11. The refrigerant then becomes high-pressure liquid refrigerant while transferring heat to the outdoor air via the heat source side heat exchanger 12. The high-pressure refrigerant from the heat source side heat exchanger 12 flows out of the outdoor unit 1 through the check valve 13*a* and enters the heat medium relay unit 3 through the refrigerant pipes 4. The high-pressure refrigerant that has entered the heat medium relay unit 3 branches after passing through the opening/closing device 17*a*, is expanded in the expansion device 16*a* and the expansion device 16*b*, and becomes a low-temperature low-pressure two-phase refrigerant. The opening/closing device 17*b* is closed.

The two-phase refrigerant flows into each of the intermediate heat exchanger 15*a* and the intermediate heat exchanger 15*b*, which serves as evaporators, and receives heat from the heat medium circulating in the heat medium circuit B, and thereby, becomes low-temperature low-pressure gas refrigerant while cooling the heat medium. The gas refrigerant that has flowed out of the intermediate heat exchanger 15*a* and the intermediate heat exchanger 15*b* flows out of the heat medium relay unit 3 through the second refrigerant channel switching device 18*a* and the second refrigerant channel switching device 18*b*, and flows into the outdoor unit 1 again through the refrigerant pipes 4. The refrigerant that has flowed into the outdoor unit 1 passes through the check valve 13*d* and is sucked into the compressor 10 again through the first refrigerant channel switching device 11 and the accumulator 19.

At this time, the second refrigerant channel switching device 18*a* and the second refrigerant channel switching device 18*b* communicate with low-pressure pipes. The opening degree of the expansion device 16*a* is controlled such that superheat (the degree of superheating) obtained as a difference between the temperature detected by the third temperature sensor 35*a* and the temperature detected by the third temperature sensor 35*b* is constant. Similarly, the opening degree of the expansion device 16*b* is controlled such that superheat obtained as a difference between the temperature detected by the third temperature sensor 35*c* and the temperature detected by the third temperature sensor 35*d* is constant.

A flow of the heat medium in the heat medium circuit B will now be described.

In the cooling-only operation mode, cooling energy of the heat source-side refrigerant is transferred to the heat medium in both of the intermediate heat exchanger 15*a* and the intermediate heat exchanger 15*b*, and the cooled heat medium is caused to move in the pipes 5 by using the pump 21*a* and the pump 21*b*. The heat medium that has been pressurized by and flowed out the pump 21*a* and the pump 21*b* enters the use-side heat exchanger 26*a* and the use-side heat exchanger 26*b* through the second heat medium channel switching device 23*a* and the second heat medium channel switching device 23*b*. The heat medium receives heat from the indoor air in the use-side heat exchanger 26*a* and the use-side heat exchanger 26*b*, thereby cooling the interior space 7.

Thereafter, the heat medium flows out of the use-side heat exchanger 26*a* and the use-side heat exchanger 26*b*, and enters the heat medium flow rate control device 25*a* and the heat medium flow rate control device 25*b*. At this time, action of the heat medium flow rate control device 25*a* and the heat medium flow rate control device 25*b* controls the flow rate of the heat medium to a flow rate necessary for generating an air conditioning load required in the room, and the resulting heat medium flows into the use-side heat exchanger 26*a* and the use-side heat exchanger 26*b*. The heat medium that has flowed out of the heat medium flow rate control device 25*a* and the heat medium flow rate control device 25*b* flows into the intermediate heat exchanger 15*a* and the intermediate heat exchanger 15*b* through the first heat medium channel switching device 22*a* and the first heat medium channel switching device 22*b*, and is sucked into the pump 21*a* and the pump 21*b* again.

In the pipes 5 of the use-side heat exchangers 26*a* and 26*b*, the heat medium flows in the direction from the second heat medium channel switching device 23 to the first heat medium channel switching device 22 by way of the heat medium flow rate control device 25. The air conditioning load required in the interior space 7 can be obtained by controlling the temperature detected by the first temperature sensor 31*a* or the difference between the temperature detected by the first temperature sensor 31*b* and the temperature detected by the second temperature sensor 34*a* or 34*b* as a target value. As the outlet temperature of the intermediate heat exchangers 15, any one of the temperature of the first temperature sensor 31*a* or the temperature of the first temperature sensor 31*b* may be used, or an average temperature of these temperatures may be used. At this time, the first heat medium channel switching device 22 and the second heat medium channel switching device 23 have intermediate opening degrees so as to obtain channels allowing the heat medium to flow toward both the intermediate heat exchanger 15*a* and the intermediate heat exchanger 15*b*.

In performing an operation in the cooling-only operation mode, the heat medium does not need to flow into the use-side heat exchanger 26 (including a thermo-off) without a thermal load, and thus, the channel is closed by the heat medium flow rate control device 25 so that the heat medium does not flow into the use-side heat exchanger 26. In FIG. 3, since the use-side heat exchangers 26*a* and 26*b* have thermal loads, the heat medium flows therein. On the other hand, since the use-side heat exchangers 26*c* and 26*d* do not operate, the corresponding heat medium flow rate control devices 25*c* and 25*d* are fully closed. In a case where a thermal load is generated in the use-side heat exchanger or a heat recovery unit operates, the heat medium flow rate control device 25 is opened so that the heat medium circulates therein.

The refrigerant in the fourth temperature sensor 50 is liquid refrigerant, and based on temperature information of this refrigerant, the heat medium relay unit control device 52 calculates a liquid inlet enthalpy. The third temperature sensor 35*d* detects the temperature of the low-pressure two-phase state, and based on this temperature information, the heat medium relay unit control device 52 calculates a saturated liquid enthalpy and a saturated gas enthalpy.

[Heating-Only Operation Mode]

Figure 4:
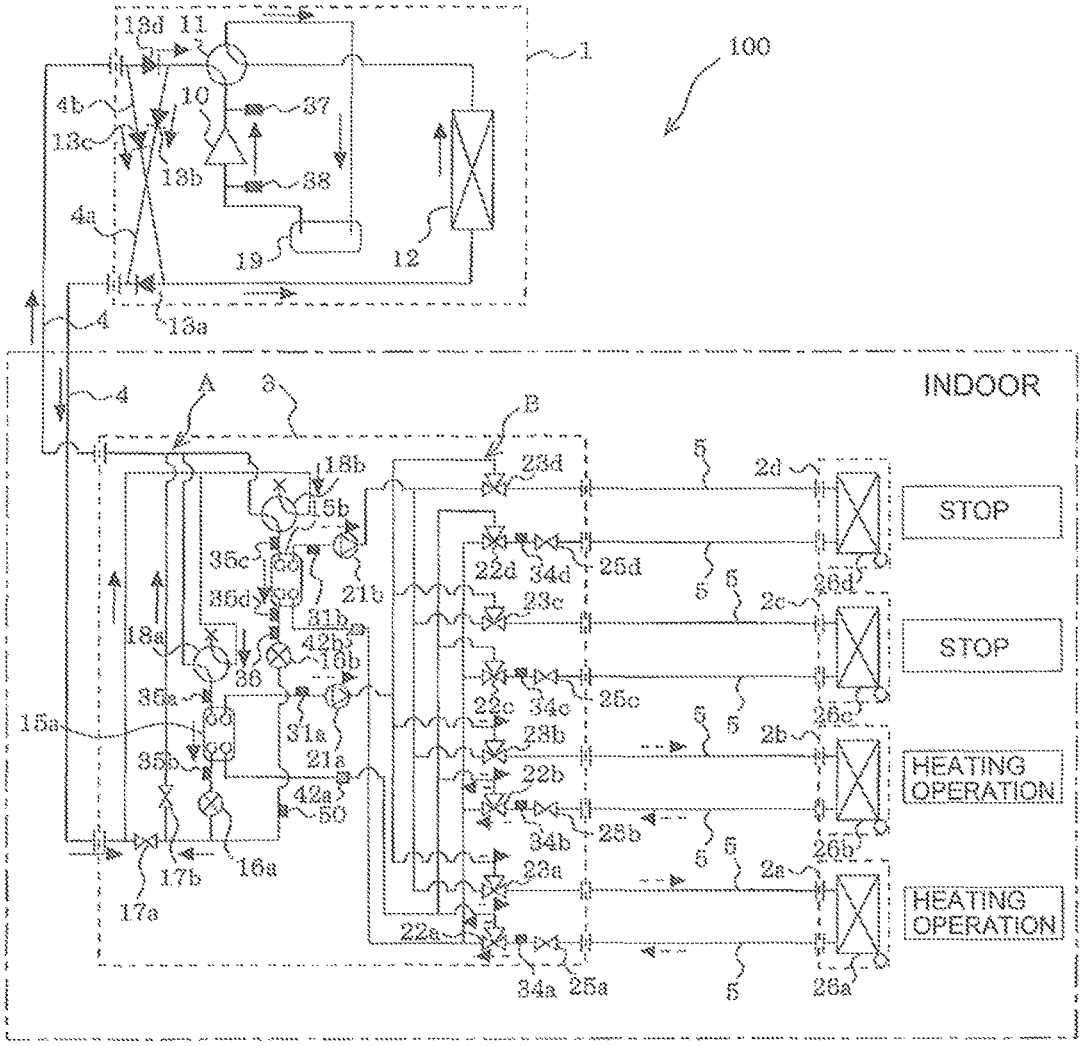
FIG. 4 is a refrigerant circuit diagram showing a flow of the refrigerant in a heating-only operation mode of the air-conditioning apparatus illustrated in FIG. 2.

FIG. 4 is a refrigerant circuit diagram showing a flow of the refrigerant in the heating-only operation mode of the air-conditioning apparatus 100 illustrated in FIG. 2. Referring to FIG. 4, the heating-only operation mode in a case where the use-side heat exchangers 26*a* and 26*b* generate heating loads will be described as an example. In FIG. 4, the direction of flow of the heat source-side refrigerant is indicated by solid arrows, and the direction of flow of the heat medium is indicated by dashed arrows.

In the case of the heating-only operation mode shown in FIG. 4, in the outdoor unit 1, the first refrigerant channel switching device 11 is switched such that the heat source-side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow rate control devices 25*a* and 25*b* are opened, and the heat medium flow rate control devices 25*c* and 25*d* are closed so that the heat medium circulates between each of the intermediate heat exchanger 15*a* and the intermediate heat exchanger 15*b* and the use-side heat exchangers 26*a* and 26*b*.

First, a flow of the heat source-side refrigerant in the refrigerant circuit A will be described.

The low-temperature low-pressure refrigerant is compressed by the compressor 10, becomes high-temperature high-pressure gas refrigerant, and is discharged. The other part of the high-temperature high-pressure gas refrigerant from the compressor 10 flows out of the outdoor unit 1 through the first refrigerant channel switching device 11 and the check valve 13*b*. The high-temperature high-pressure gas refrigerant that has flowed out of the outdoor unit 1 enters the heat medium relay unit 3 through the refrigerant pipes 4. The high-temperature high-pressure gas refrigerant that has entered the heat medium relay unit 3 branches, and flows into the intermediate heat exchanger 15*a* and the intermediate heat exchanger 15*b* through the second refrigerant channel switching device 18*a* and the second refrigerant channel switching device 18*b*.

The high-temperature high-pressure gas refrigerant that has flowed into the intermediate heat exchanger 15*a* and the intermediate heat exchanger 15*b* becomes high-pressure liquid refrigerant while transferring heat to the heat medium circulating in the heat medium circuit B. The liquid refrigerant that has flowed out of the intermediate heat exchanger 15*a* and the intermediate heat exchanger 15*b* is expanded in the expansion device 16*a* and the expansion device 16*b*, and becomes low-temperature low-pressure two-phase refrigerant. This two-phase refrigerant flows out of the heat medium relay unit 3 through the opening/closing device 17*b*, and enters the outdoor unit 1 again through the refrigerant pipes 4. The opening/closing device 17*a* is closed.

The refrigerant that has entered the outdoor unit 1 passes through the check valve 13*c* and flows into the heat source side heat exchanger 12 serving as an evaporator. The refrigerant that has entered the heat source side heat exchanger 12 then absorbs heat from the outdoor air in the heat source side heat exchanger 12, and becomes low-temperature low-pressure gas refrigerant. The low-temperature low-pressure gas refrigerant that has flowed out of the heat source side heat exchanger 12 is sucked into the compressor 10 again through the first refrigerant channel switching device 11 and the accumulator 19.

At this time, the second refrigerant channel switching device 18*a* and the second refrigerant channel switching device 18*b* communicate with high-pressure pipes. The opening degree of the expansion device 16*a* is controlled such that subcool (the degree of subcooling) obtained as a difference between a value converted into a saturation temperature from the pressure detected by the first pressure sensor 36 and the temperature detected by the third temperature sensor 35*b* is constant. Similarly, the opening degree of the expansion device 16*b* is controlled such that subcool obtained as a difference between a value converted into a saturation temperature from the pressure detected by the first pressure sensor 36 and the temperature detected by the third temperature sensor 35*d* is constant. In a case where the temperature at an intermediate location of the intermediate heat exchanger 15 can be measured, the temperature at this intermediate location may be used instead of the first pressure sensor 36. In this case, the system can be configured at low cost.

A flow of the heat medium in the heat medium circuit B will now be described.

In the heating-only operation mode, heating energy of the heat source-side refrigerant is transferred to the heat medium in both of the intermediate heat exchanger 15*a* and the intermediate heat exchanger 15*b*, and the heated heat medium is caused to move in the pipes 5 by using the pump 21*a* and the pump 21*b*. The heat medium that has been pressurized by and flowed out the pump 21*a* and the pump 21*b* enters the use-side heat exchanger 26*a* and the use-side heat exchanger 26*b* through the second heat medium channel switching device 23*a* and the second heat medium channel switching device 23*b*. The heat medium transfers heat to the indoor air in the use-side heat exchanger 26*a* and the use-side heat exchanger 26*b*, thereby heating the interior space 7.

Thereafter, the heat medium flows out of the use-side heat exchanger 26*a* and the use-side heat exchanger 26*b*, and flows into the heat medium flow rate control device 25*a*, the heat medium flow rate control device 25*b*, and the heat medium flow rate control device 25*c*. At this time, action of the heat medium flow rate control device 25*a* and the heat medium flow rate control device 25*b* controls the flow rate of the heat medium at a flow rate necessary for generating an air conditioning load required in the room, and the resulting heat medium flows into the use-side heat exchanger 26*a* and the use-side heat exchanger 26*b*. The heat medium that has flowed out of the heat medium flow rate control device 25*a* and the heat medium flow rate control device 25*b* flows into the intermediate heat exchanger 15*a* and the intermediate heat exchanger 15*b* through the first heat medium channel switching device 22*a* and the first heat medium channel switching device 22*b*, and is sucked into the pump 21*a* and the pump 21*b* again.

In pipes 5 of the use-side heat exchanger 26, the heat medium flows in the direction from the second heat medium channel switching device 23 to the first heat medium channel switching device 22 by way of the heat medium flow rate control device 25. The air conditioning load required in the interior space 7 can be obtained by controlling the temperature detected by the first temperature sensor 31*a* or the difference between the temperature detected by the first temperature sensor 31*b* and the temperature detected by the second temperature sensor 34*a* or 34*b* as a target value. As the outlet temperature of the intermediate heat exchangers 15, any one of the temperature of the first temperature sensor 31*a* or the temperature of the first temperature sensor 31*b* may be used, or an average temperature of these temperatures may be used.

At this time, the first heat medium channel switching device 22 and the second heat medium channel switching device 23 have intermediate opening degrees so as to obtain channels allowing the heat medium to flow toward both the intermediate heat exchanger 15*a* and the intermediate heat exchanger 15*b*. Although the use-side heat exchanger 26 should be originally controlled based on the temperature difference between the inlet and outlet thereof, the heat medium temperature at the inlet of the use-side heat exchanger 26 is substantially the same as the temperature detected by the first temperature sensor 31*b*, and thus, the use of the first temperature sensor 31*b* can reduce the number of temperature sensors. As a result, the system can be configured at low cost.

In performing an operation in the heating-only operation mode, the heat medium does not need to flow into the use-side heat exchanger 26 (including a thermo-off) without a thermal load, and thus, the channel is closed by the heat medium flow rate control device 25 so that the heat medium does not flow into the use-side heat exchanger 26. In FIG. 4, since the use-side heat exchangers 26*a* and 26*b* have thermal loads, the heat medium flows therein. On the other hand, since the use-side heat exchangers 26*c* and 26*d* do not operate, the corresponding heat medium flow rate control devices 25*c* and 25*d* are fully closed. In a case where a thermal load is generated in the use-side heat exchanger or a heat recovery unit operates, the heat medium flow rate control device 25 is opened so that the heat medium circulates therein.

[Cooling Main Operation Mode]

Figure 5:
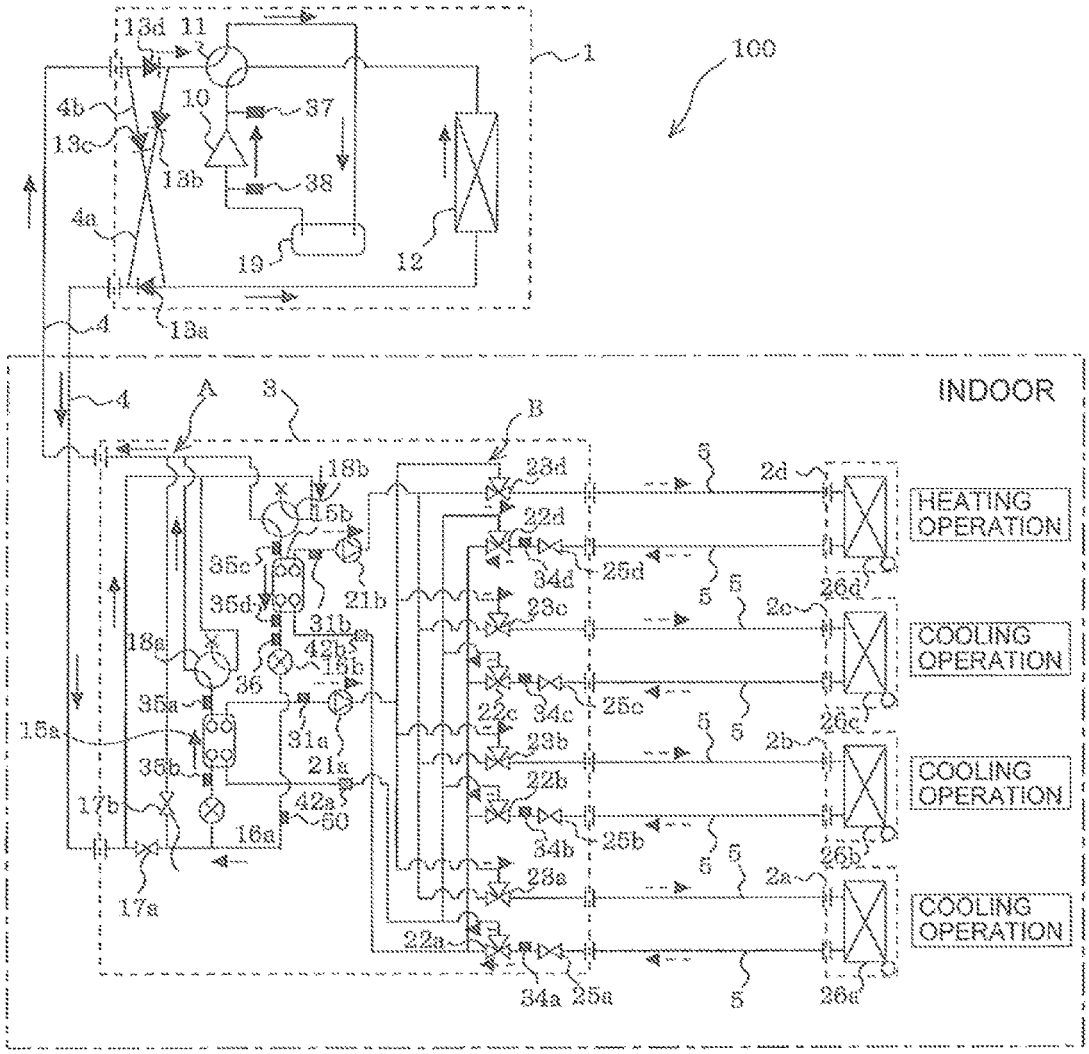
FIG. 5 is a refrigerant circuit diagram showing a flow of the refrigerant in a cooling main operation mode of the air-conditioning apparatus illustrated in FIG. 2.

FIG. 5 is a refrigerant circuit diagram showing a flow of the refrigerant in the cooling main operation mode of the air-conditioning apparatus 100 illustrated in FIG. 2. Referring to FIG. 5, the cooling main operation mode in a case where the use-side heat exchanger 26*d* generates a heating load and the use-side heat exchangers 26*a* to 26*c* generate cooling loads will be described as an example. In FIG. 5, the direction of flow of the heat source-side refrigerant is indicated by solid arrows, and the direction of flow of the heat medium is indicated by dashed arrows.

In the case of the cooling main operation mode shown in FIG. 5, in the outdoor unit 1, the first refrigerant channel switching device 11 is switched such that the heat source-side refrigerant discharged from the compressor 10 flows into the heat source side heat exchanger 12. In the heat medium relay unit 3, the pump 21*a* and the pump 21*b* are driven and the heat medium flow rate control devices 25*a* to 25*d* are opened so that the heat medium circulates between the intermediate heat exchanger 15*a* and the use-side heat exchangers 26*a* to 26*c* and between the intermediate heat exchanger 15*b* and the use-side heat exchanger 26*d*.

First, a flow of the heat source-side refrigerant in the refrigerant circuit A will be described.

The low-temperature low-pressure refrigerant is compressed by the compressor 10, becomes high-temperature high-pressure gas refrigerant, and is discharged. The other part of the high-temperature high-pressure gas refrigerant from the compressor 10 flows into the heat source side heat exchanger 12 through the first refrigerant channel switching device 11. The refrigerant then becomes liquid refrigerant while transferring heat to the outdoor air in the heat source side heat exchanger 12. The refrigerant from the heat source side heat exchanger 12 flows out of the outdoor unit 1 and enters the heat medium relay unit 3 through the check valve 13*a* and the refrigerant pipes 4. The refrigerant that has flowed into the heat medium relay unit 3 passes through the second refrigerant channel switching device 18*b* and flows into the intermediate heat exchanger 15*b* serving as a condenser.

The refrigerant that has flowed into the intermediate heat exchanger 15*b* becomes refrigerant having a reduced temperature while transferring heat to the heat medium circulating in the heat medium circuit B. The refrigerant that has flowed out of the intermediate heat exchanger 15*b* is expanded in the expansion device 16*b* and becomes low-pressure two-phase refrigerant. The low-pressure two-phase refrigerant flows into the intermediate heat exchanger 15*a* serving as an evaporator through the expansion device 16*a*. The low-pressure two-phase refrigerant that has flowed into the intermediate heat exchanger 15*a* receives heat from the heat medium circulating in the heat medium circuit B, and becomes low-pressure gas refrigerant while cooling the heat medium. The gas refrigerant flows out of the intermediate heat exchanger 15*a*, flows out of the heat medium relay unit 3 through the second refrigerant channel switching device 18*a*, and enters the outdoor unit 1 again through the refrigerant pipes 4. The refrigerant that has entered the outdoor unit 1 is sucked into the compressor 10 again through the check valve 13*d*, the first refrigerant channel switching device 11, and the accumulator 19.

At this time, the second refrigerant channel switching device 18*a* communicates with the low-pressure pipe, whereas the second refrigerant channel switching device 18*b* communicates with the high-pressure side pipe. The opening degree of the expansion device 16*b* is controlled such that superheat obtained as a difference between the temperature detected by the third temperature sensor 35*a* and the temperature detected by the third temperature sensor 35*b* is constant. The expansion device 16*a* is fully open, and the opening/closing devices 17*a* and 17*b* are fully closed. The opening degree of the expansion device 16*b* may be controlled such that subcool obtained as a difference between a value converted into a saturation temperature from the pressure detected by the first pressure sensor 36 and the temperature detected by the third temperature sensor 35*d* is constant. The expansion device 16*b* may be fully open so that the expansion device 16*a* controls the superheat or the subcool.

A flow of the heat medium in the heat medium circuit B will now be described.

In the cooling main operation mode, heating energy of the heat source-side refrigerant is transferred to the heat medium in the intermediate heat exchanger 15*b*, and the heated heat medium is caused to move in the pipes 5 by using the pump 21*b*. In addition, in the cooling main operation mode, cooling energy of the heat source-side refrigerant is transferred to the heat medium in the intermediate heat exchanger 15*a*, and the cooled heat medium is caused to move in the pipes 5 by using the pump 21*a*.

In the use-side heat exchanger 26*d*, the heat medium transfers heat to the indoor air, thereby heating the interior space 7. In the use-side heat exchangers 26*a* to 26*c*, the heat medium receives heat from the indoor air, thereby cooling the interior space 7. At this time, action of the heat medium flow rate control devices 25*a* to 25*d* controls the flow rate of the heat medium at a flow rate necessary for generating an air conditioning load required in the room, and the resulting heat medium flows into the use-side heat exchangers 26*a* to 26*d*. The heat medium that has passed through the use-side heat exchanger 26*d* and has its temperature slightly reduced, flows into the intermediate heat exchanger 15*b* through the heat medium flow rate control device 25*d* and the first heat medium channel switching device 22*d*, and is sucked into the pump 21*b* again. The heat medium that has passed through the use-side heat exchangers 26*a* to 26*c* and has its temperature slightly increased, flows into the intermediate heat exchanger 15*a* through the heat medium flow rate control devices 25*a* to 25*c* and the first heat medium channel switching devices 22*a* to 22*c*, and is sucked into the pump 21*a* again.

During this flow, the hot heat medium and the cold heat medium are not mixed together because of the action of the first heat medium channel switching device 22 and the second heat medium channel switching device 23, and are individually introduced into the use-side heat exchangers 26*a* to 26*d* having heating loads and cooling loads. In the pipes 5 of the use-side heat exchangers 26*a* to 26*d*, the heat medium flows in the direction from the second heat medium channel switching device 23 to the first heat medium channel switching device 22 by way of the heat medium flow rate control device 25 in each of the heating side and the cooling side. The air conditioning load required in the interior space 7 can be supplied by controlling the difference between the temperature detected by the first temperature sensor 31*b* and the temperature detected by the second temperature sensor 34 in the heating side and the difference between the temperature detected by the second temperature sensor 34 and the temperature detected by the first temperature sensor 31*a* in the cooling side, as respective target values.

In performing an operation in the cooling main operation mode, the heat medium does not need to flow into the use-side heat exchanger 26 (including a thermo-off) without a thermal load, and thus, the channels closed by the heat medium flow rate control device 25 so that the heat medium does not flow into the use-side heat exchanger 26. In FIG. 5, since there are no use-side heat exchangers 26 without thermal loads, all the heat medium flow rate control devices 25 are open.

[Heating Main Operation Mode]

Figure 6:
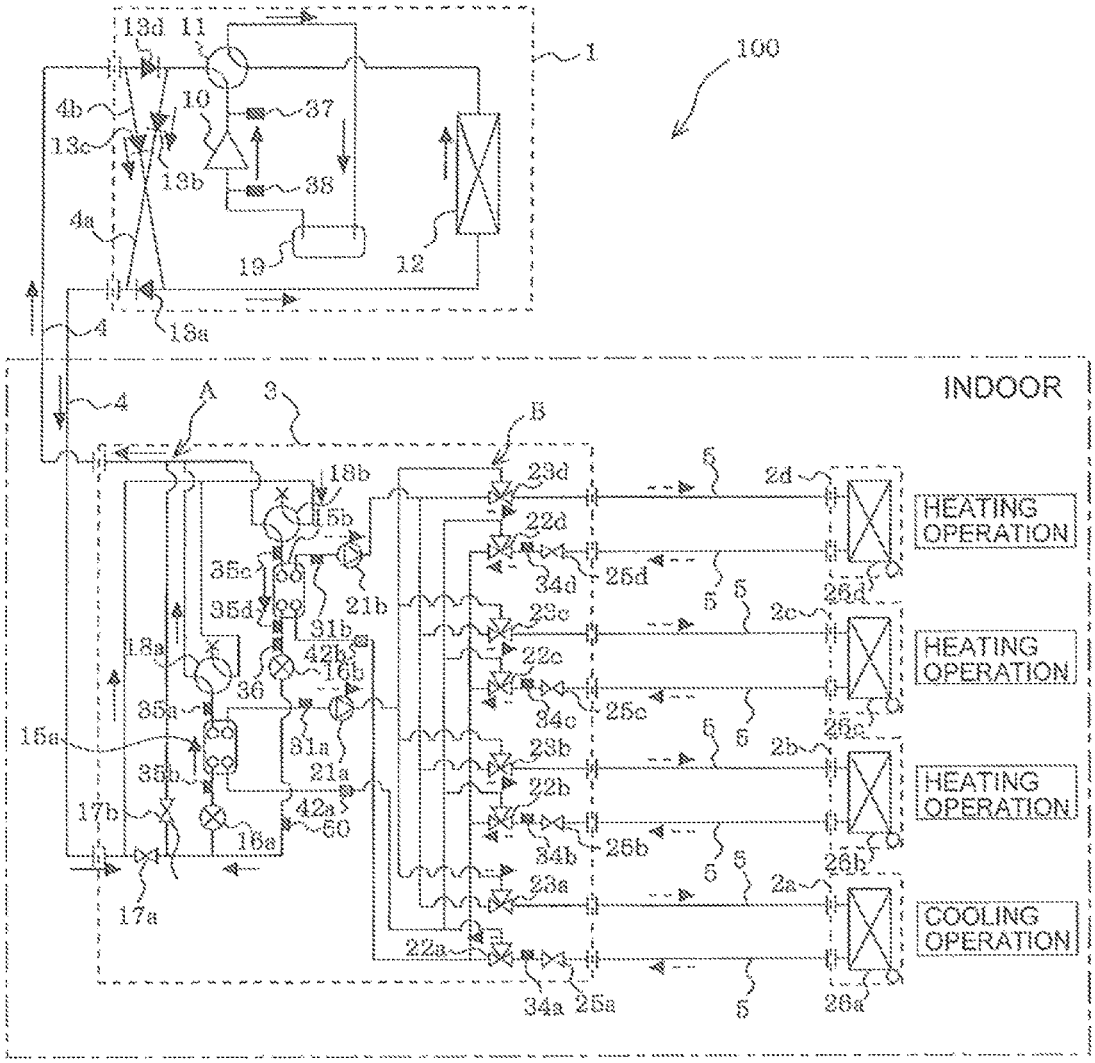
FIG. 6 is a refrigerant circuit diagram showing a flow of the refrigerant in a heating main operation mode of the air-conditioning apparatus illustrated in FIG. 2.

FIG. 6 is a refrigerant circuit diagram showing a flow of the refrigerant in the heating main operation mode of the air-conditioning apparatus 100 illustrated in FIG. 2. Referring to FIG. 6, the heating main operation mode in a case where the use-side heat exchangers 26*b* to 26*d* generate heating loads and the use-side heat exchanger 26*a* generates a cooling load will be described as an example. In FIG. 6, the direction of flow of the heat source-side refrigerant is indicated by solid arrows, and the direction of flow of the heat medium is indicated by dashed arrows.

In the case of the heating main operation mode illustrated in FIG. 6, in the outdoor unit 1, the first refrigerant channel switching device 11 is switched such that the heat source-side refrigerant discharged from the compressor 10 does not pass through the heat source side heat exchanger 12 and flows into the heat medium relay unit 3. In the heat medium relay unit 3, the pump 21*a* and the pump 21*b* are driven and the heat medium flow rate control devices 25*a* to 25*d* are opened so that the heat medium circulates between the intermediate heat exchanger 15*a* and the use-side heat exchanger 26*a* and between the intermediate heat exchanger 15*b* and the use-side heat exchangers 26*b* to 26*d*.

First, a flow of the heat source-side refrigerant in the refrigerant circuit A will be described.

The low-temperature low-pressure refrigerant is compressed by the compressor 10, becomes high-temperature high-pressure gas refrigerant, and is discharged. The other part of the high-temperature high-pressure gas refrigerant from the compressor 10 flows out of the outdoor unit 1 through the first refrigerant channel switching device 11 and the check valve 13*b*. The high-temperature high-pressure gas refrigerant that has flowed out of the outdoor unit 1 enters the heat medium relay unit 3 through the refrigerant pipes 4. The high-temperature high-pressure gas refrigerant that has entered the heat medium relay unit 3 passes through the second refrigerant channel switching device 18*b* and flows into the intermediate heat exchanger 15*b* serving as a condenser.

The gas refrigerant that as flowed into the intermediate heat exchanger 15*b* becomes liquid refrigerant while transferring heat to the heat medium circulating in the heat medium circuit B. The refrigerant that has flowed out of the intermediate heat exchanger 15*b* is expanded in the expansion device 16*b* and becomes low-pressure two-phase refrigerant. This low-pressure two-phase refrigerant passes through the expansion device 16*a* and flows into the intermediate heat exchanger 15*a* serving as an evaporator. The low-pressure two-phase refrigerant that has flowed into the intermediate heat exchanger 15*a* evaporates by absorbing heat from the heat medium circulating in the heat medium circuit B, thereby cooling the heat medium. This low-pressure two-phase refrigerant flows out of the intermediate heat exchanger 15*a*, flows out of the heat medium relay unit 3 through the second refrigerant channel switching device 18*a*, and flows into the outdoor unit 1 again.

The refrigerant that has flowed into the outdoor unit 1 passes through the check valve 13*c* and enters the heat source side heat exchanger 12 serving as an evaporator. The refrigerant that has flowed into the heat source side heat exchanger 12 then absorbs heat from the outdoor air in the heat source side heat exchanger 12, and becomes low-temperature low-pressure gas refrigerant. The low-temperature low-pressure gas refrigerant that has flowed out of the heat source side heat exchanger 12 is sucked into the compressor 10 again through the first refrigerant channel switching device 11 and the accumulator 19.

At this time, the second refrigerant channel switching device 18*a* communicates with the low-pressure side pipe, whereas the second refrigerant channel switching device 18*b* communicates with the high-pressure side pipe. The opening degree of the expansion device 16*b* is controlled such that subcool obtained as a difference between a value converted from the pressure detected by the first pressure sensor 36 into a saturation temperature and the temperature detected by the third temperature sensor 35*b* is constant. The expansion device 16*a* is fully open, and the opening/closing devices 17*a* and 17*b* are closed. The subcool may be controlled by using the expansion device 16*a* with the expansion device 16*b* being fully open.

A flow of the heat medium in the heat medium circuit B will now be described.

In the heating main operation mode, heating energy of the heat source-side refrigerant is transferred to the heat medium in the intermediate heat exchanger 15*b*, and the heated heat medium is caused to move in the pipes 5 by using the pump 21*b*. In the heating main operation mode, cooling energy of the heat source-side refrigerant is transferred to the heat medium in the intermediate heat exchanger 15*a*, and the cooled heat medium is caused to move in the pipes 5 by using the pump 21*a*. The heat medium that has been pressurized by and flowed out the pump 21*a* and the pump 21*b* enters the use-side heat exchangers 26*a* to 26*d* through the second heat medium channel switching device 23*a* and the second heat medium channel switching device 23*b*.

In the use-side heat exchanger 26*a*, the heat medium receives heat from the indoor air, thereby cooling the interior space 7. In the use-side heat exchangers 26*b* to 26*d*, the heat medium transfers heat to the indoor air, thereby heating the interior space 7. At this time, action of the heat medium flow rate control device 25*a* and the heat medium flow rate control device 25*b* controls the flow rate of the heat medium at a flow rate necessary for generating an air conditioning load required in the room, and the resulting heat medium flows into the use-side heat exchangers 26*a* to 26*d*. The heat medium that has passed through the use-side heat exchanger 26*a* and has its temperature slightly increased, flows into the intermediate heat exchanger 15*a* through the heat medium flow rate control device 25*a* and the first heat medium channel switching device 22*a*, and is sucked into the pump 21*a* again. The heat medium that has passed through the use-side heat exchangers 26*b* to 26*d* and has its temperature slightly reduced, flows into the intermediate heat exchanger 15*b* through the heat medium flow rate control devices 25*b* to 25*d* and the first heat medium channel switching devices 22*b* to 22*d*, and is sucked into the pump 21*b* again.

During this flow, the hot heat medium and the cold heat medium are not mixed together because of the action of the first heat medium channel switching device 22 and the second heat medium channel switching device 23, and individually flow into the use-side heat exchanger 26*a* having a heating load and the use-side heat exchangers 26*b* to 26*d* having cooling loads. In the pipes 5 of the use-side heat exchanger 26*a* and 26*b* to 26*d*, the heat medium flows in the direction from the second heat medium channel switching device 23 to the first heat medium channel switching device 22 by way of the heat medium flow rate control device 25 in each of the heating side and the cooling side. The air conditioning load required in the interior space 7 can be supplied by controlling the difference between the temperature detected by the first temperature sensor 31*b* and the temperature detected by the second temperature sensor 34 in the heating side and the difference between the temperature detected by the second temperature sensor 34 and the temperature detected by the first temperature sensor 31*a* in the cooling side, as respective target values.

In performing an operation in the heating main operation mode, the heat medium does not need to flow into the use-side heat exchanger 26 (including a thermo-off) without a thermal load, and thus, the channel is closed by the heat medium flow rate control device 25 so that the heat medium does not flows into the use-side heat exchanger 26. In FIG. 6, since all the use-side heat exchangers 26*a* to 26*d* have thermal loads, the heat medium flows therein. In a case where there is a use-side heat exchanger without a thermal load, the corresponding heat medium flow rate control device 25 is fully closed.

[Foreign Matter Removal Operation Mode and Air Purge Operation Mode]

Figure 7:
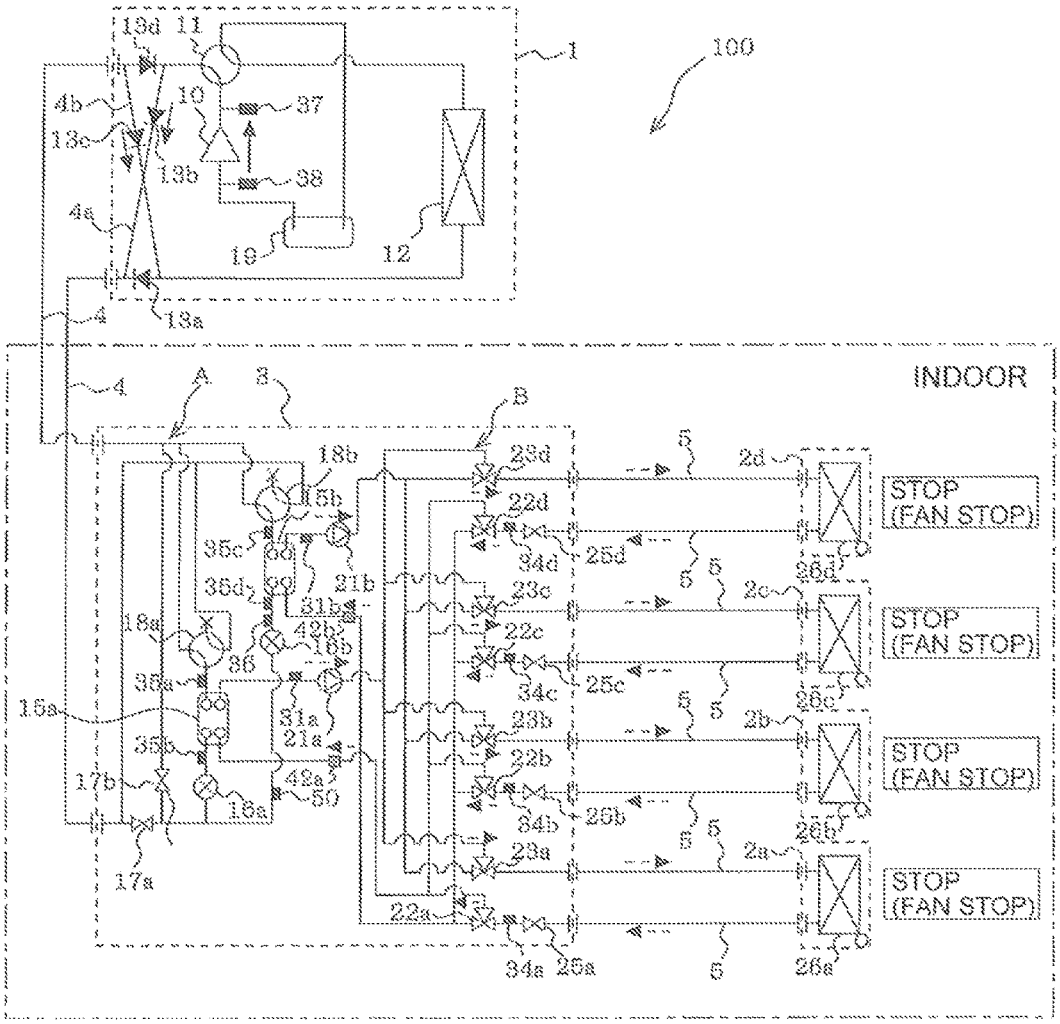
FIG. 7 is a refrigerant circuit diagram showing a flow of the refrigerant in a foreign matter removal operation mode and an air purge operation mode of the air-conditioning apparatus illustrated in FIG. 2.

FIG. 7 is a view illustrating a flow of the heat medium in the foreign matter removal operation mode and the air purge operation mode in Embodiment 1 of the present invention. The foreign matter removal operation mode and the air purge operation mode are modes of operation in which the heat medium circuit B is charged with the heat medium during, for example, construction (installation) of the air-conditioning apparatus 100 (i.e., before an actual operation of a cooling or heating operation).

In this embodiment, in the foreign matter removal operation mode and the air purge operation mode, an operation of the refrigerant circuit A is optional. Thus, the refrigerant circuit A does not operate in this embodiment, and the following description will be given on a case where only the heat medium circuit B operates. Referring now to FIG. 7, a flow of the heat medium in the heat medium circuit B will be described. Since the flow of the heat medium in the heat medium circuit B is the same in the foreign matter removal operation mode and the air purge operation mode, the flows in both of the modes will be commonly described.

In the foreign matter removal operation mode and the air purge operation mode, the heat medium is caused to move in the pipes 5 under pressurization of the pump 21. The heat medium that has been sucked into the pump 21*a* and the pump 21*b* and been pressurized and flowed out, flows into the use-side heat exchangers 26*a* to 26*d* through the second heat medium channel switching device 23*a* to 23*d*. Here, the air-sending devices (not shown) of the indoor units 2*a* to 2*d* may be stopped so that the use-side heat exchangers 26*a* to 26*d* do not actively exchange heat between the heat medium and the indoor air.

The heat medium that has passed through the use-side heat exchangers 26*a* to 26*d* passes through the heat medium flow rate control devices 25*a* to 25*d*. At this time, the opening degrees of the heat medium flow rate control devices 25*a* to 25*d* are increased at maximum (i.e., fully opened) so that the heat medium flow rate control devices 25*a* to 25*d* do not inhibit the flow of the heat medium. The heat medium that has flowed out of the heat medium flow rate control devices 25*a* to 25*d* passes through the first heat medium channel switching devices 22*a* to 22*d*. Then, the heat medium passes through the intermediate heat exchanger 15*a* and the intermediate heat exchanger 15*b* and is sucked into the pump 21*a* and the pump 21*b* again.

In view of this, in the configuration of FIG. 7, the opening degrees of the heat medium flow rate control devices 25*a* to 25*d* are increased to the maximum so that the heat medium can pass through all the indoor units 2. However, the present invention is not limited to this configuration. For example, as will be described later, in the air purge operation mode, the heat medium may pass through part of the indoor units 2. Although the refrigerant circuit A does not operate in this embodiment, the refrigerant circuit A may operate in the air purge operation mode in a manner similar to that in the heating-only operation mode, for example. The increased temperature of the heat medium can promote the release of air included in the heat medium, thereby more efficiently purging the air in the heat medium circuit B.

Figure 8:
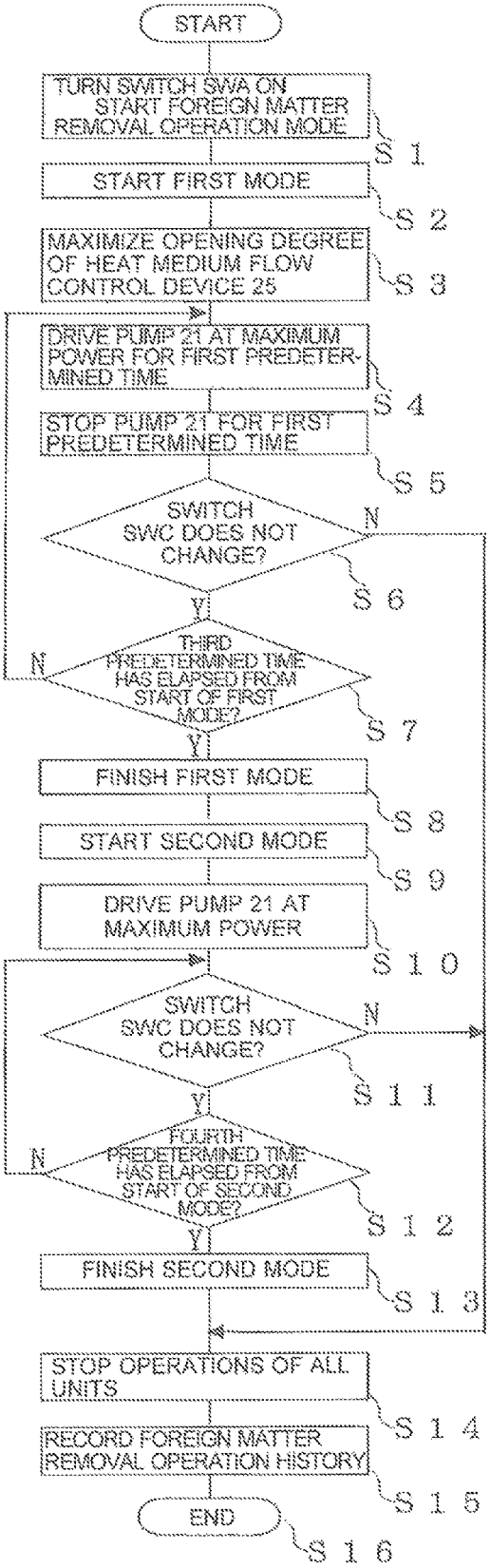
FIG. 8 is a flowchart showing processes of a heat medium relay unit control device 52 in the foreign matter removal operation mode of Embodiment 1.

FIG. 8 is a flowchart showing processes in the foreign matter removal operation mode of the heat medium relay unit control device 52 of Embodiment 1 of the present invention. Referring to FIG. 8, the processes performed by the heat medium relay unit control device 52 in the foreign matter removal operation mode will be described.

When determining that a constructor, for example, turns on the switch SWA for the foreign matter removal operation mode, the heat medium relay unit control device 52 starts the foreign matter removal operation mode (step S1), and performs the following process under automatic control. The foreign matter removal operation mode includes a first mode and a second mode. Then, the first mode is started (step S2). The opening degree of the heat medium flow rate control device 25 is then increased to the maximum (step S3).

The pumps 21*a* and 21*b* are driven under maximum power (100%) for a first predetermined time (e.g., 10 seconds) (step S4). The pumps 21*a* and 21*b* are stopped for a second predetermined time (e.g., 10 seconds) (step S5), and are intermittently driven. In the first mode, the intermittent driving of the pump 21 is intended to prevent, for example, air entrainment occurring when air is entrained in the heat medium. Then, it is determined whether the switch SWC for stopping operation in the heat medium relay unit control device 52 changes (e.g., on to off or off to on) (step S6). If it is determined that the switch SWC changes, all the units are stopped (step S14). If it is determined that the switch SWC does not change, it is determined whether a third predetermined time (e.g., 20 minutes) has elapsed from the start of the first mode (step S7). If it is determined that the third predetermined time has not elapsed, processes from step S4 to step S6 are repeated. On the other hand, if it is determined that the third predetermined time has elapsed, the first mode is finished (step S8).

When the first mode is finished, the second mode is started (step S9). In the second mode, the pumps 21*a* and 21*b* are driven under maximum power (step S10). In addition, it is determined whether the switch SWC for stopping operation in the heat medium relay unit control device 52 changes (step S11). If it is determined that the switch SWC changes, all the units are stopped (step S14). If it is determined that the switch SWC does not change, it is determined whether a fourth predetermined time (e.g., 20 minutes) has elapsed from the start of the second mode (step S12). If it is determined that the fourth predetermined time has not elapsed, the process of step S11 is repeated. If the switch SWC for stopping operation does not change, driving of the pump 21 continues. If it is determined that the fourth predetermined time has elapsed, the second mode is finished (step S13). Then, all the units are stopped (step S14).

Then heat medium relay unit control device 52 records data on the date and time, and termination time, as history of the foreign matter removal operation, in the recording device 53 (step 15), thereby finishing an operation in the foreign matter removal operation mode (step 16).

Figure 9:
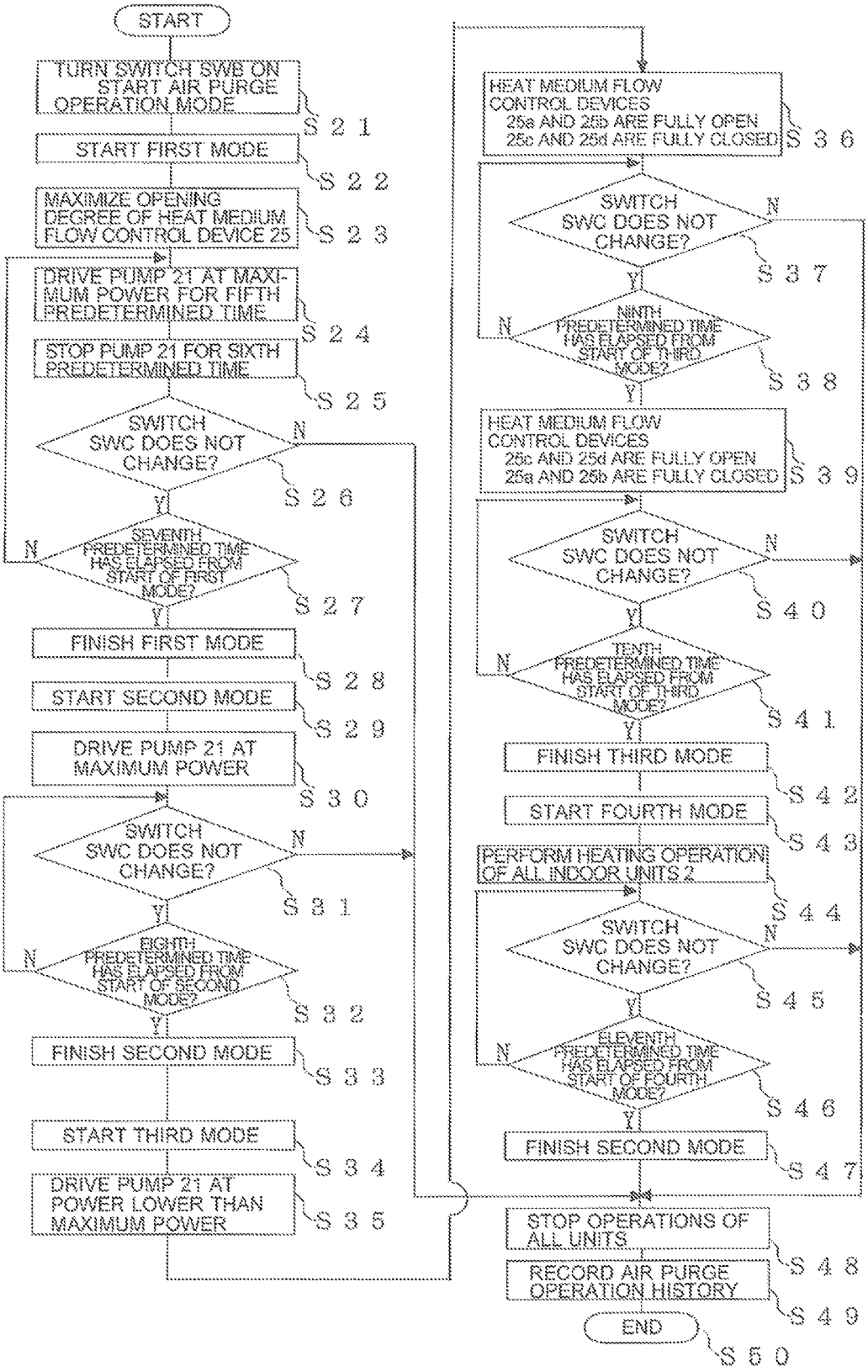
FIG. 9 is a flowchart showing processes of the heat medium relay unit control device 52 in the air purge operation mode of Embodiment 1.

FIG. 9 is a flowchart showing processes in the air purge operation mode of the heat medium relay unit control device 52 of Embodiment 1 of the present invention. Referring to FIG. 9, the processes performed by the heat medium relay unit control device 52 in the air purge operation mode will be described.

When determining that a constructor, for example, turns on the switch SWB for the air purge operation mode, the heat medium relay unit control device 52 starts the air purge operation mode (step S21), and performs the following process under automatic control. The air purge operation mode includes first through fourth modes. Thus, the first mode is first started (step S22). The opening degree of the heat medium flow rate control device 25 is then increased to the maximum (step S23).

The pumps 21*a* and 21*b* are driven under maximum power for a fifth predetermined time (e.g., 10 seconds) (step S24). The pumps 21*a* and 21*b* are stopped for a sixth predetermined time (e.g., 10 seconds) (step S25), and are intermittently driven. It is determined that the switch SWC for operation stop in the heat medium relay unit control device 52 changes (step S26). If it is determined that the switch SWC changes, all the units are stopped (step S48). If it is determined that the switch SWC does not change, the first mode is started, and then it is determined whether a seventh predetermined time (e.g., 20 minutes) has elapsed (step S27). If it is determined that the seventh predetermined time has not elapsed, processes from step S24 through step S26 are repeated. On the other hand, if it is determined that the seventh predetermined time has elapsed, the first mode is finished (step S28).

When the first mode is finished, the second mode is started (step S29). In the second mode, the pumps 21*a* and 21*b* are driven under maximum power (step S30). It is determined whether the switch SWC for operation stop in the heat medium relay unit control device 52 changes (step S31). If it is determined that the switch SWC changes, all the units are stopped (step S48). If it is determined that the switch SWC does not change, it is determined whether an eighth predetermined time (e.g., 20 minutes) has elapsed since the second mode has started (step S32). If it is determined that the eighth predetermined time does not elapsed, processes of the step S31 is repeated, and if the switch SWC for operation stop does not change, the pump 21 is continuously driven. If it is determined whether the eighth predetermined time has elapsed, the second mode is finished (step S33).

When the second mode is finished, the third mode is started (step S34). In the third mode, the pumps 21*a* and 21*b* are driven under power (e.g., 50%) lower than the maximum power (step S35). Then, the opening degrees of the heat medium flow rate control devices 25*a* and 25*b* are increased to the maximum, and the heat medium flow rate control devices 25*c* and 25*d* are closed so that the heat medium does not flow toward the indoor units 2*c* and 2*d* (step S36). Thus, the channel length in the heat medium circuit B decreases, and the flow rate of the heat medium relative to power can be increased. It is also determined whether the switch SWC for operation stop in the heat medium relay unit control device 52 changes (step S37). If it is determined that the switch SWC changes, all the units are stopped (step S48). If it is determined that the switch SWC does not change, the third mode is started, and then it is determined whether a ninth predetermined time (e.g., 10 minutes) has elapsed (step S38). If it is determined that the ninth predetermined time has not elapsed, the process of step S37 is repeated. If it is determined that the switch SWC for operation stop does not change, the pump 21 is continuously driven.

If it is determined that the ninth predetermined time has elapsed, the opening degrees of the heat medium flow rate control devices 25*c* and 25*d* are then increased to the maximum, and the heat medium flow rate control devices 25*a* and 25*b* are closed so that the heat medium does not flow toward the indoor units 2*a* and 2*b* (step S39). It is also determined that the switch SWC for operation stop in the heat medium relay unit control device 52 changes (step S40). If it is determined that the switch SWC changes, all the units are stop (step S48). If it is determined that the switch SWC does not change, the third mode is started, and then it is determined whether a tenth predetermined time (e.g., 20 minutes, 10 minutes after changing the heat medium flow rate control device 25) has elapsed (step S41). If it is determined that the tenth predetermined time has not elapsed, the process of step S40 is repeated. If the switch SWC for operation stop does not change, the pump 21 is continuously driven. If it is determined that the ninth predetermined time has elapsed, the third mode is finished (step S42). Here, in this embodiment, four indoor units 2 are provided, and the pipes 5 branch into four parts. Thus, two processes are performed for each two branches. For example, in a case where the number of the indoor units 2 (the number of branches) is large, the above-described processes are performed on all the indoor units 2 (branches). The number of the indoor units 2 for which the above-described processes are performed at a time (i.e., the number of branches) is preferably, but not limited to, performed on two branches at most in consideration of the channel length.

When the third mode is finished, the fourth mode is started (step S43). In the fourth mode, the opening degrees of all the heat medium flow rate control device 25 are increased to the maximum, and heating is performed in all the indoor units 2 (step S44). Thus, the refrigerant circuit A also performs an operation in the heating-only operation mode. Here, the air-sending devices (not shown) of the indoor units 2 may be driven or may not be driven. It is also determined whether the switch SWC for operation stop in the heat medium relay unit control device 52 changes (step S45). If it is determined that the switch SWC changes, all the units are stopped (step S48). If it is determined that the switch SWC does not change, the fourth mode is started, and then it is determined whether an eleventh predetermined time (e.g., 10 minutes) has elapsed (step S46). If it is determined that the eleventh predetermined time has not elapsed, the process of step S45 is repeated. If it is determined that the switch SWC for operation stop does not change, the pump 21 is continuously driven. On the other hand, if it is determined that the eleventh predetermined time has elapsed, the fourth mode is finished (step S47). Then, all the units are stopped (step S48).

The heat medium relay unit control device 52 then records data on date and time, and termination time, as history of an air purge operation, in the recording device 53 (step 49), and an operation in the air purge operation mode is finished (step 50).

As described above, in the air-conditioning apparatus 100 of Embodiment 1, the heat medium relay unit control device 52 can perform a foreign matter removal operation and an air purge operation in constructing the heat medium circuit B. Thus, foreign matter removal and air purge can be efficiently performed. In addition, since data concerning history of the foreign matter removal operation and the air purge operation is recorded in the recording device 53, it is possible to determine whether an operation is performed or not during, for example, maintenance by providing a display on the display device 54. Thus, it is possible to support specifying a cause of a failure of equipment, such as because the equipment operated with foreign matter and air being entrained. In this embodiment, the display device 54 is provided. Alternatively, an external reading device may be used.

Embodiment 2

Figure 10:
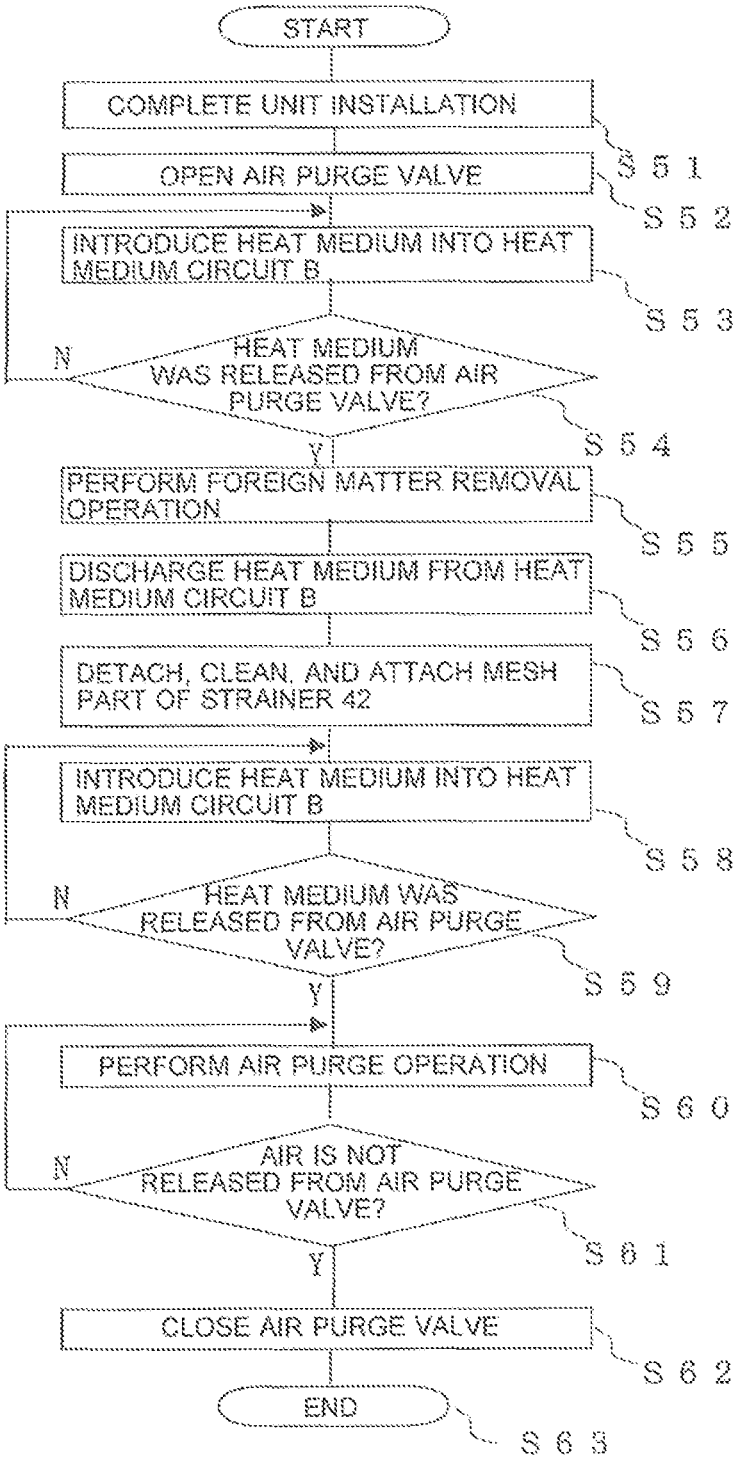
FIG. 10 is a flowchart showing a procedure in charging with a heat medium in constructing an air-conditioning apparatus 100 according to Embodiment 2 of the present invention.

FIG. 10 is a flowchart showing a procedure in charging with a heat medium in constructing an air-conditioning apparatus 100 according to Embodiment 2 of the present invention. In a manner similar to the air-conditioning apparatus 100 described above, the procedure shown in FIG. 10 is performed in charging with the heat medium in the air-conditioning apparatus that can perform operations in a foreign matter removal operation mode and an air purge operation mode.

First, when construction of a refrigerant circuit A and a heat medium circuit B and unit installation such as construction of wires and pipes are completed (step S51), an indoor unit air purge valve 40 and a heat medium relay unit air purge valve 41 are opened so that the inside of the heat medium circuit B communicates with the outside (step S52). In a case where an indoor unit 2 is located above the heat medium relay unit 3 in terms of height, a heat medium relay unit air purge valve 41 may be closed.

Figure 11:
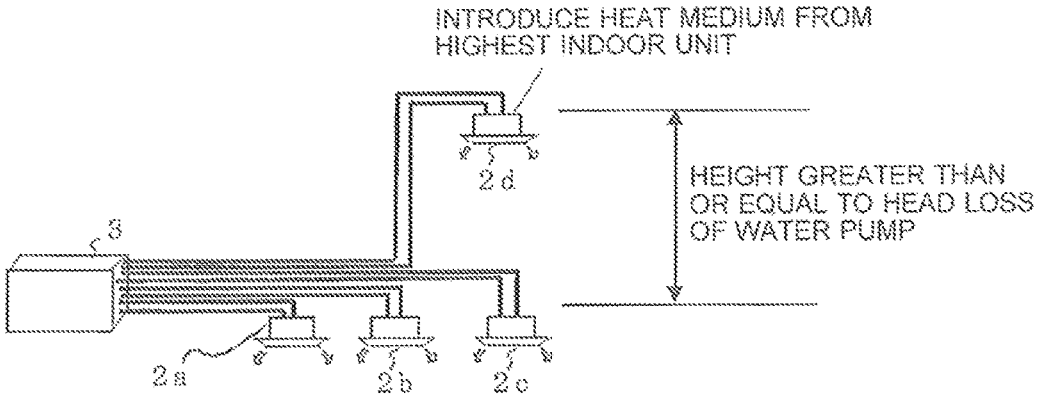
FIG. 11 illustrates an example of heat medium injection.

FIG. 11 illustrates an example of heat medium introduction. Next, the heat medium is introduced from at least one of a heat medium relay unit heat medium inlet 44 or indoor unit heat medium inlets 43*a* to 43*d* (step S53). In a case where one of the indoor units 2 in FIG. 11 is located at such a position that the height of the heat medium relay unit 3 is above the head of the pump 21, the heat medium is introduced from the indoor unit heat medium inlet 43 of the indoor unit 2. In this embodiment, the heat medium is introduced in step S53. However, since the heat medium in this step is a medium used for removing foreign matter and is to be discharged later, the medium is not limited to the heat medium. In consideration of contamination and other factors, the heat medium or liquid close to the heat medium is preferable.

If it is determined that the heat medium was flowed out from the indoor unit air purge valves 40*a* to 40*d* and the heat medium relay unit air purge valves 41*a* to 41*b* (step S54), an operation in a foreign matter removal mode described in Embodiment 1 is performed (step S55). The operation is preferably performed, but not limited to, after it has been confirmed that the heat medium is flowed out of the open indoor unit air purge valves 40*a* to 40*d* and all the heat medium relay unit air purge valves 41*a* to 41*b*.

After the operation in the foreign matter removal mode has been finished, the heat medium is discharged from the heat medium circuit B (step S56). Then, in each of the strainers 42, the mesh part (not shown) for capturing foreign matter is taken out, cleaned, and attached to the strainer 42 again (step S57).

Thereafter, in a manner similar to step S53, the heat medium is introduced from an inlet of at least one of the heat medium relay unit heat medium inlet 44 and the indoor unit heat medium inlets 43*a* to 43*d* (step S58). After the heat medium has been flowed out of the indoor unit air purge valves 40*a* to 40*d* and the heat medium relay unit air purge valves 41*a* to 41*b* (step S59), an operation in the air purge mode described in Embodiment 1 is performed (step 60).

Here, in a case where air is released from the indoor unit air purge valve 40 or the heat medium relay unit air purge valve 41 at the end of operation in the air purge mode (step S61), the operation in the air purge mode is performed again. If the air is not released, the indoor unit air purge valve 40 and the heat medium relay unit air purge valve 41 are closed (step S62), and the operation is finished (step S63).

REFERENCE SIGNS LIST

1 outdoor unit, 2, 2*a* to 2*d* indoor unit, 3 heat medium relay unit, 4, 4*a*, 4*b* refrigerant pipe, 5 pipe, 6 outdoor space, 7 interior space, 8 air space, 9 structure, 10 compressor, 11 first refrigerant channel switching device, 12 heat source side heat exchanger, 13*a* to 13*d* check valve, 15, 15*a*, 15*b* intermediate heat exchanger, 16, 16*a*, 16*b* expansion device, 17, 17*a*, 17*b* opening/closing device, 18, 18*a*, 18*b* second refrigerant channel switching device, 19 accumulator, 21, 21*a*, 21*b* pump, 22, 22*a* to 22*d* first heat medium channel switching device, 23, 23*a* to 23*d* second heat medium channel switching device, 25, 25*a* to 25*d* heat medium flow rate control device, 26, 26*a* to 26*d* use-side heat exchanger, 31, 31*a*, 31*b* first temperature sensor, 34, 34*a* to 34*d* second temperature sensor, 35, 35*a* to 35*d* third temperature sensor, 36 first pressure sensor, 37 second pressure sensor, 38 third pressure sensor, 39, 39*a* to 39*d* sucked air temperature detecting device, 40, 40*a* to 40*d* indoor unit air purge valve, 41, 41*a*, 41*b* heat medium relay unit air purge valve, 42, 42*a*, 42*b* strainer, 43, 43*a* to 43*d* indoor unit heat medium inlet, 44 heat medium relay unit heat medium inlet, 50 fourth temperature sensor, 52 heat medium relay unit control device, 53 recording device, 54 display device, 57 outdoor unit control device, 100 air-conditioning apparatus, A refrigerant circuit, B heat medium circuit

The invention claimed is:

1. An air-conditioning apparatus comprising:

a refrigerant circuit in which a compressor for compressing heat source-side refrigerant, a refrigerant channel switching device for switching a circulation path of the heat source-side refrigerant, a heat source side heat exchanger for performing heat exchange of the heat source-side refrigerant, an expansion device for adjusting a pressure of the heat source-side refrigerant, and one or more intermediate heat exchangers for performing heat exchange between the heat source-side refrigerant and a heat medium different from the heat source-side refrigerant are connected by first pipes;

a heat medium circuit in which one or more pumps for circulating the heat medium to be used for the heat exchange performed by the one or more intermediate heat exchangers, a use-side heat exchanger for performing heat exchange between the heat medium and air in an air-conditioned space, and a channel switching device for switching passages of the heat medium heated or cooled to the use-side heat exchanger are connected by second pipes, the heat medium circuit including one or more air purge valves configured to release air from inside the heat medium circuit;

a controller configured to perform an air purge operation in which the refrigerant circuit heats the heat medium to purge air in the heat medium, and the one or more pumps of the heat medium circuit are intermittently driven for a predetermined time in a plurality of times thereby removing the air from the heat medium circuit during construction of the heat medium circuit; and a recorder provided separately from the controller and configured to store data concerning execution of the air purge operation, wherein once the controller performs the air purge operation, the data concerning execution of the air purge operation is stored in the recorder, wherein the predetermined time defines a fixed time interval.

2. The air-conditioning apparatus of claim 1, wherein the controller performs the air purge operation under automatic control.

3. The air-conditioning apparatus of claim 2, further comprising a switch for instructing the automatic control of the air purge operation.

4. The air-conditioning apparatus of claim 1, wherein in a case where one or both of an indoor unit including the use-side heat exchanger and the pipes of the heat medium circuit are disposed at a location higher than the one or more pumps and higher than or equal to a head of the one or more pumps, a heat medium supply port for supplying the heat medium is provided in one of the indoor unit and the pipes of the heat medium circuit.

5. The air-conditioning apparatus of claim 1, further comprising:

a display, wherein the controller causes the data concerning execution of the air purge operation and recorded in the recorder to be displayed on the display.

6. The air-conditioning apparatus of claim 1, wherein the heat medium circuit further includes a strainer disposed at a suction side of the one or more pumps and configured to capture foreign matter contained in the heat medium; and the controller configured to perform a foreign matter removal operation of causing the heat medium to circulate in the heat medium circuit so that the strainer captures foreign matter contained in the heat medium circuit during the construction of the heat medium circuit.

7. The air-conditioning apparatus of claim 1, wherein the one or more pumps of the heat medium circuit are intermittently driven for the predetermined time in the plurality of times by driving the one or more pumps at a first power for a first time period, and driving the one or more pumps at a second power lower than the first power for a second time period different than the first time period.

* * * * *